US011751001B2

(12) United States Patent
Fujiwara et al.

(10) Patent No.: US 11,751,001 B2
(45) Date of Patent: Sep. 5, 2023

(54) AUDIO SYSTEM FOR ELEVATOR

(71) Applicant: Mitsubishi Electric Corporation, Tokyo (JP)

(72) Inventors: Susumu Fujiwara, Tokyo (JP); Keigo Taruishi, Tokyo (JP); Masami Aikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/789,584

(22) PCT Filed: Mar. 13, 2020

(86) PCT No.: PCT/JP2020/011231
§ 371 (c)(1),
(2) Date: Jun. 28, 2022

(87) PCT Pub. No.: WO2021/181693
PCT Pub. Date: Sep. 16, 2021

(65) Prior Publication Data

US 2023/0060349 A1 Mar. 2, 2023

(51) Int. Cl.
*H04S 7/00* (2006.01)
*B66B 3/00* (2006.01)
(Continued)

(52) U.S. Cl.
CPC ..... *H04S 7/305* (2013.01); *B66B 3/00* (2013.01); *H04R 1/02* (2013.01); *H04R 1/403* (2013.01);
(Continued)

(58) Field of Classification Search
CPC . H04S 7/30; H04S 7/301; H04S 7/302; H04S 7/305; H04S 2420/01; H04R 1/02;
(Continued)

(56) References Cited

U.S. PATENT DOCUMENTS

2005/0137859 A1* 6/2005 Yoshino ..... H04S 7/301 704/205
2006/0251271 A1* 11/2006 Grimani ..... H04R 1/403 381/94.5
(Continued)

FOREIGN PATENT DOCUMENTS

JP S62-119373 U 7/1987
JP H03-210899 A 9/1991
(Continued)

OTHER PUBLICATIONS

International Search Report of the International Searching Authority dated May 26, 2020 for the corresponding international application No. PCT/JP2020/011231 (and English translation).

*Primary Examiner* — Jason R Kurr
(74) *Attorney, Agent, or Firm* — POSZ LAW GROUP, PLC

(57) ABSTRACT

An audio system for an elevator includes two or more speaker cabinets arranged inside a suspended ceiling fixed to a ceiling board of a car of the elevator, an input device to which sound content radiated to an inside of the car from each of the two or more speaker cabinets are input, and a sound field control device configured to conduct phase control and reverberation time control for the sound content and thereby cause a sound wave based on the sound content to be radiated from the speaker cabinet to the inside of the car. Each of the speaker cabinets includes a casing arranged inside the suspended ceiling, and a speaker unit arranged inside the casing and having a radiation surface that radiates the sound wave.

9 Claims, 21 Drawing Sheets

(51) Int. Cl.
*H04R 1/02* (2006.01)
*H04R 1/40* (2006.01)

(52) U.S. Cl.
CPC ..... *H04R 1/406* (2013.01); *H04R 2201/021* (2013.01)

(58) Field of Classification Search
CPC .. H04R 1/403; H04R 1/406; H04R 2201/021; B66B 3/00
See application file for complete search history.

(56) References Cited

U.S. PATENT DOCUMENTS

| | | | | |
|---|---|---|---|---|
| 2015/0146896 | A1* | 5/2015 | Pahkala | H04R 19/00 381/191 |
| 2016/0021481 | A1* | 1/2016 | Johnson | H04R 5/04 381/303 |
| 2017/0026750 | A1* | 1/2017 | Mansfield | H04R 3/14 |
| 2019/0071280 | A1* | 3/2019 | Marvin | B66B 11/0226 |
| 2022/0095051 | A1* | 3/2022 | Yamamoto | H04R 1/347 |

FOREIGN PATENT DOCUMENTS

| | | | |
|---|---|---|---|
| JP | 2004-021162 | A | 1/2004 |
| JP | 2008-035133 | A | 2/2008 |
| JP | 2009-035340 | A | 2/2009 |
| JP | 5322607 | B2 | 10/2013 |

* cited by examiner

AUDIO SYSTEM FOR ELEVATOR

CROSS REFERENCE TO RELATED APPLICATION

This application is a U.S. national stage application of International Patent Application No. PCT/JP2020/011231 filed on Mar. 13, 2020, the disclosure of which is incorporated herein by reference.

TECHNICAL FIELD

The present disclosure relates to an audio system for an elevator configured to radiate sound to the inside of a car of the elevator.

BACKGROUND

In a car of a related-art elevator, a speaker configured to provide a passenger inside the car with voice guidance is installed. Further, an intercom configured for a passenger to, in case of emergency, speak to a person outside the car is installed inside the car. In general, such a speaker and such an intercom are installed in a car operation panel.

Further, for example, Patent Literature 1 discloses an elevator configured to send out BGM (background music) as well as voice guidance to the inside of a car. This elevator has provided inside a car thereof a speaker and a BGM reproduction device configured to reproduce BGM.

Further, Patent Literature 2 discloses an elevator having a plurality of speakers placed at regular intervals in a vertically linear fashion. This elevator is configured such that in a case in which a car travels upward, audio signals are outputted in sequence to a speaker installed at the uppermost position first and then to a speaker installed at the lowermost position. This gives a passenger the feeling that an audio signal has moved downward. By thus switching in sequence from outputting an audio signal to one speaker to outputting an audio signal to another speaker, this elevator can give a passenger the feeling that the elevator is ascending or descending.

PATENT LITERATURE

Patent Literature 1: Japanese Unexamined Patent Application Publication No. 2009-35340

Patent Literature 2: Japanese Patent No. 5322607

The elevator disclosed in Patent Literature 1 has one speaker installed inside the car. The elevator disclosed in Patent Literature 2 has a plurality of speakers vertically arranged side by side.

However, in the elevators disclosed in Patent Literatures 1 and 2, sound radiated from the speakers do not uniformly reach the ears of all passenger in a case in which the insides of the cars are full. A reason for that is explained. First, sound from a speaker installed near a passenger is radiated toward the body of the passenger. At this point in time, the sound radiated from the speaker is absorbed into the body of the passenger, as the body of the passenger per se is a "sound-absorbing material". Therefore, the sound from the speaker does not sufficiently reach a passenger present in a place distant from the speaker.

Further, the elevators disclosed in Patent Literatures 1 and 2 do not create stereoscopic sound field environments, nor are they superior in sound quality, as the speakers radiate monaurally reproduced sound.

Further, Patent Literature 2 is undesirably expensive, as the number of speakers is large.

SUMMARY

The present disclosure has been made to solve such problems and an object thereof is to provide an audio system for an elevator configured to, while having a reduced number of speaker units, form a stereoscopic sound field environment throughout the inside of a car and thereby bring about improvement in sound quality.

An audio system for an elevator according to an embodiment of the present disclosure includes two or more speaker cabinets arranged inside a suspended ceiling fixed to a ceiling board of a car of the elevator, an input device to which sound content radiated to an inside of the car from each of the two or more speaker cabinets are input, and a sound field control device configured to conduct a control as phase control and reverberation time control for the sound content and thereby cause a sound wave based on the sound content to be radiated from the speaker cabinet to the inside of the car. Each of the speaker cabinets includes a casing arranged inside the suspended ceiling, and a speaker unit arranged inside the casing and having a radiation surface that radiates the sound wave.

The audio system for an elevator according to the embodiment of the present disclosure makes it possible to, while having a reduced number of speaker units, form a stereoscopic sound field environment throughout the inside of a car and thereby bring about improvement in sound quality.

DETAILED DESCRIPTION

Figure 1:
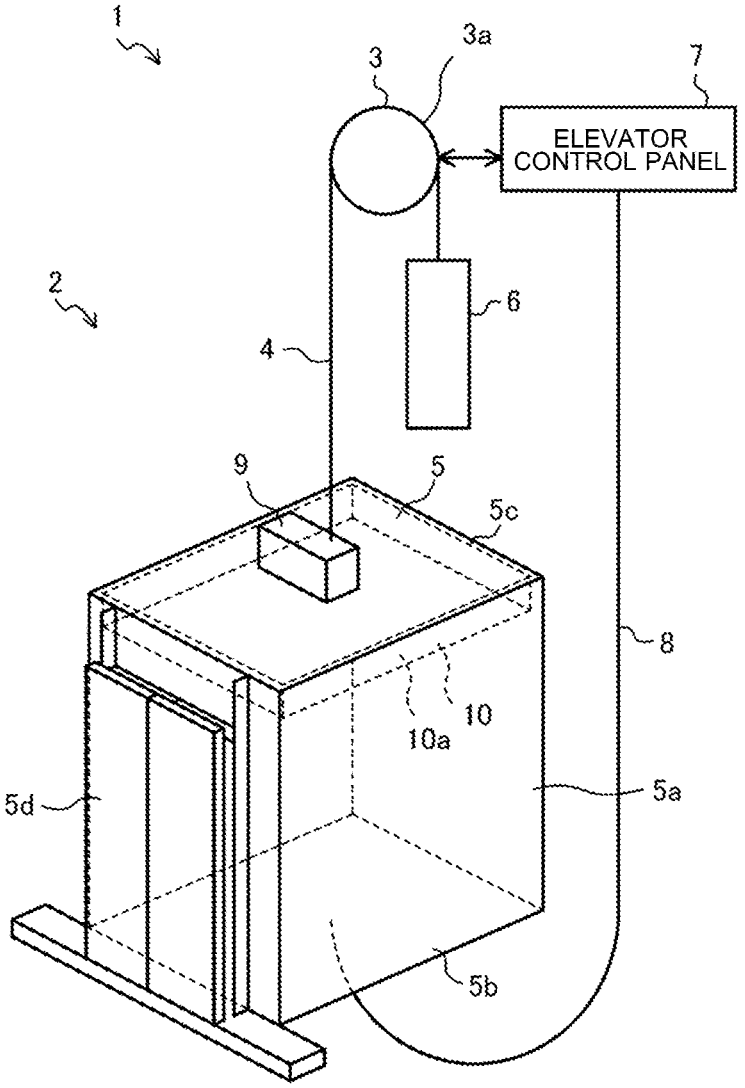
FIG. 1 is a perspective view showing a configuration of an elevator 1 according to Embodiment 1.

In the following, audio systems for an elevator according to embodiments of the present disclosure are described with reference to the drawings. The present disclosure is not limited to the following embodiments, but may be modified in various ways, provided such modifications do not depart from the scope of the present disclosure. Further, the present disclosure encompasses all combinations of combinable components of components of the following embodiments and modifications thereof. Further, components given identical signs in the drawings are identical or equivalent to each other, and these signs are adhered to throughout the full text of the description. In the drawings, relative relationships in dimension between components, the shapes of the components, or other features of the components may be different from actual ones.

Embodiment 1

FIG. 1 is a perspective view showing a configuration of an elevator 1 according to Embodiment 1. As shown in FIG. 1, the elevator 1 is installed inside a building and configured to ascend or descend through the inside of a hoistway 2. In an upper part of the hoistway 2, a hoisting machine 3 is provided. The hoisting machine 3 is provided with a sheave 3*a*. Over the sheave 3*a*, a main rope 4 is stretched. The main rope 4 has two ends coupled to a car 5 and a balancing weight 6, respectively. The car 5 and the balancing weight 6 are reversibly suspended from the sheave 3*a* by the main rope 4. Further, in the upper part of the hoistway 2, an elevator control panel 7 is installed. The elevator control panel 7 is connected to the hoisting machine 3 via a communication line and connected to the car 5 via a control cable 8. The control cable 8 transmits electricity and control signals to the car 5. The control cable 8 is also referred to as "tail cord".

The car 5 is formed of four side boards 5*a*, a floor board 5*b*, and a ceiling board 5*c*. The four side boards 5*a* are located on the right, left, front, and back sides, respectively, of the car 5. Further, in the front side board 5*a* of the four side boards 5*a*, a car door 5*d* is installed. Each time the car 5 stops at an elevator hall on a floor of the building, the car door 5*d* conducts opening and closing operations in engagement with an elevator hall door (not illustrated) installed in the elevator hall.

On an upper surface of the ceiling board 5*c* of the car 5, as shown in FIG. 1, a car control device 9 is installed. The car control device 9 conducts control of operation of devices provided in the car 5. Examples of the devices provided in the car 5 include the car door 5*d*, a lighting device 5*e* (see FIG. 2), a car operation panel 5*f* (see FIG. 2), and an audio system 13 for an elevator (see FIG. 3). The audio system 13 for an elevator is hereinafter simply referred to as "audio system 13".

To a lower surface of the ceiling board 5*c* of the car 5, as shown in FIG. 1, a suspended ceiling 10 is fixed. The suspended ceiling 10 has a cuboidal shape. The suspended ceiling 10 has four side surfaces 10*a* and a lower surface 10*b* (see FIG. 2). Further, the suspended ceiling 10 may further have an upper surface disposed to face the lower surface 10*b*. In an internal space of the suspended ceiling 10, the lighting device 5*e* (see FIG. 2) and the audio system 13 (see FIG. 3) are installed. Between the side surfaces 10*a* of the suspended ceiling 10 and the side boards 5*a* of the car 5, there is a gap 11 of a constant distance D (see FIGS. 2 and 3). The constant distance D is hereinafter referred to as "first distance D".

Although the example shown in FIG. 1 illustrates a case in which the elevator 1 is a rope elevator, this case is not intended to impose any limitation. The elevator 1 may for example be another type of elevator such as a maglev elevator.

Figure 2:
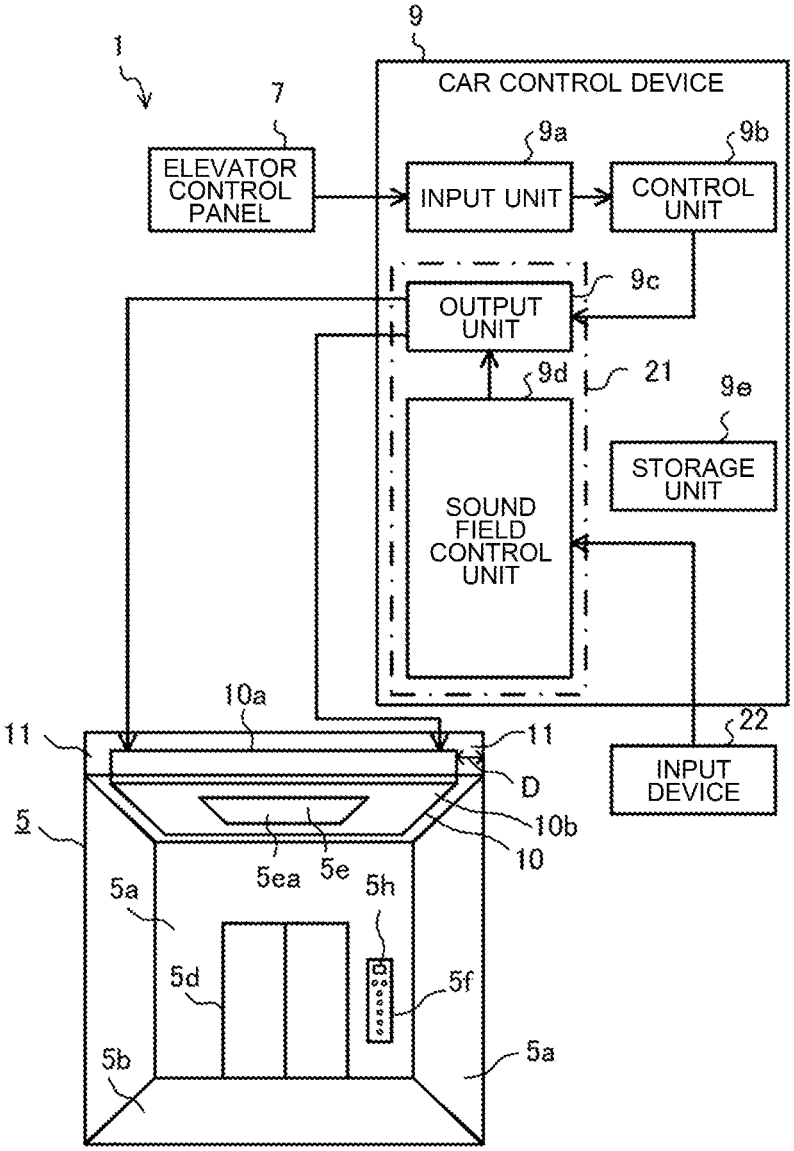
FIG. 2 is a diagram showing an internal appearance of a car 5 of the elevator 1 according to Embodiment 1.

FIG. 2 is a diagram showing an internal appearance of the car 5 of the elevator 1 according to Embodiment 1. As shown in FIG. 2, an internal space of the car 5 is surrounded by the side boards 5*a*, the floor board 5*b*, and the lower surface 10*b* of the suspended ceiling 10. The internal space of the car 5 is for example in the shape of a cuboid. The floor board 5*b* is formed of a flat surface placed in a horizontal direction. The side boards 5*a* are formed of flat surfaces placed in a perpendicular direction. The term "perpendicular direction" here means, for example, a vertical direction. The lower surface 10*b* of the suspended ceiling 10 is disposed to face the floor board 5*b*. The suspended ceiling 10 is provided with the lighting device 5*e*. The lighting device 5*e* has its body installed in the internal space of the suspended ceiling 10. The lighting device 5*e* is for example an LED lighting device. As shown in FIG. 2, the lighting device 5*e* has an illumination surface 5*ea* facing the floor board 5*b*. The lighting device 5*e* illuminates the internal space of the car 5 with light shone from the illumination surface 5*ea*.

As mentioned above, the front side board 5*a* of the four side boards 5*a* is provided with the car door 5*d*. Further, as shown in FIG. 2, the front side board 5*a* is provided with the car operation panel 5*f*. The car operation panel 5*f* is provided with a plurality of car call registration buttons provided separately in correspondence with each floor and door opening and closing buttons configured to control opening and closing operations of the car door 5*d*. Furthermore, the car operation panel 5*f* is provided with an intercom device 5*h* configured for a passenger to have outside communications in case of emergency. In addition to being used to have outside communications, the intercom device 5*h* may also be used to send out a voice message such as "THE DOOR WILL CLOSE" to a passenger.

As shown in FIG. 2, the car control device 9 is connected to the elevator control panel 7, for example, via the control cable 8 (see FIG. 1). As shown in FIG. 2, the car control device 9 includes an input unit 9*a*, a control unit 9*b*, an output unit 9*c*, a sound field control unit 9*d*, and a storage unit 9*e*. The input unit 9*a* inputs control signals from the elevator control panel 7 to the control unit 9*b*. Based on these control signals, the control unit 9*b* conducts control of operation of the devices provided in the car 5. Under control of the control unit 9*b*, the output unit 9*c* outputs driving signals separately to each of the devices. Further, under control of the control unit 9*b*, the output unit 9*c* transmits, to the elevator control panel 7, a signal of, for example, car call registration inputted from a passenger to the car operation panel 5*f*. The sound field control unit 9*d* is one of the constituent elements of the audio system 13. The sound field control unit 9*d* controls the operation of the audio system 13 to form a stereoscopic sound field with high sound quality throughout the internal space of the car 5. The output unit 9*c* and the sound field control unit 9*d* form the after-mentioned sound field control device 21.

A hardware configuration of the car control device 9 is described here. Functions of the input unit 9*a*, the control unit 9*b*, the output unit 9*c*, and the sound field control unit 9*d* in the car control device 9 are implemented by a processing circuit. The processing circuit is formed of dedicated hardware or a processor. The dedicated hardware is for example an ASIC (application specific integrated circuit), an FPGA (Field Programmable Gate Array), or other hardware. The processor executes a program stored in a memory. The storage unit 9*e* is formed of the memory. The memory is a nonvolatile or volatile semiconductor memory such as a RAM (random-access memory), a ROM (read-only memory), a flash memory, or an EPROM (erasable programmable ROM) or a disc such as a magnetic disc, a flexible disc, or an optical disc.

Figure 3:
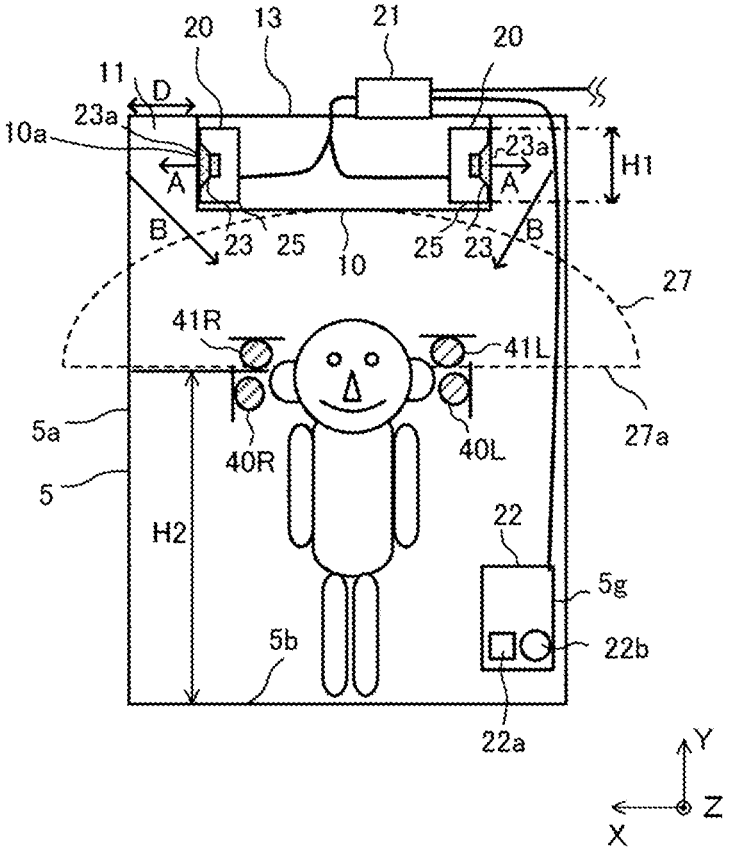
FIG. 3 is a front view showing a configuration of an audio system 13 according to Embodiment 1.
Figure 4:
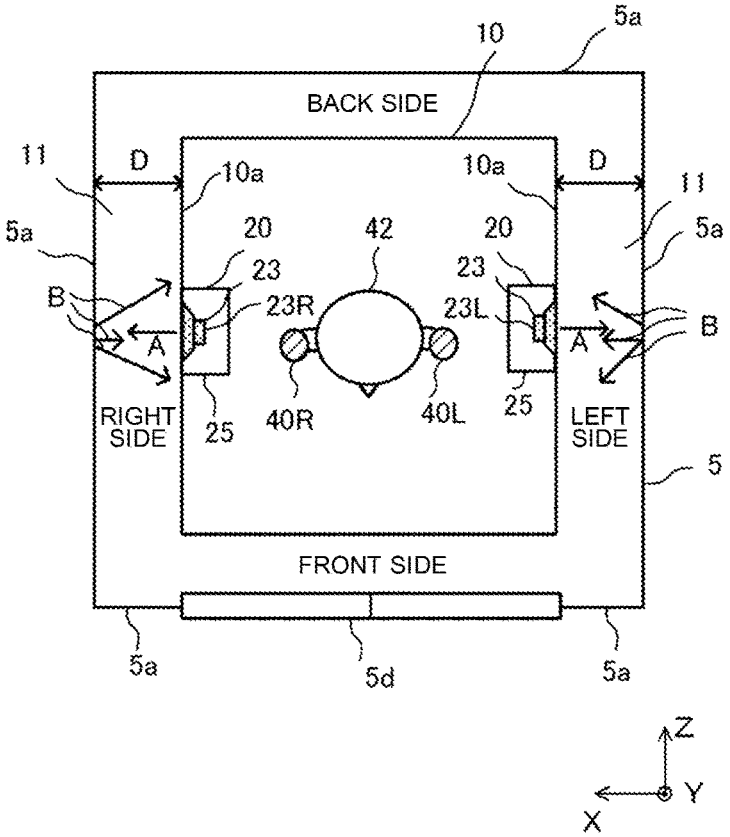
FIG. 4 is a top view showing an arrangement of speaker cabinets 20 of the audio system 13 according to Embodiment 1.

FIG. 3 is a front view showing a configuration of the audio system 13 according to Embodiment 1. FIG. 4 is a top view showing an arrangement of speaker cabinets 20 of the audio system 13 according to Embodiment 1. Let it be assumed in FIGS. 3 and 4 that a direction parallel with the height of the car 5 is a Y direction, that a direction parallel with the width of the car 5 is an X direction, and that a direction parallel with the depth of the car 5 is a Z direction. The Y direction is for example a vertical direction. Further, as shown in FIG. 4, the right, left, front, and back of the inside of the car 5 are defined such that the X direction is a direction from side to side of the car 5 and the Z direction is a direction toward both the front and back of the car 5.

As shown in FIGS. 3 and 4, the audio system 13 is formed of one or more speaker cabinets 20, a sound field control device 21, and an input device 22. The audio system 13 radiates sound to a passenger in the car 5. Embodiment 1 uses, as the sound, sound content, such as the murmur of a river or the chirping of a bird, that calls up an image of nature is used as the sound.

According to Embodiment 1, as shown in FIG. 3, the number of speaker cabinets 20 is 2. However, the number of speaker cabinets 20 is not limited to this number but may be any number larger than or equal to 1. As shown in FIG. 3, each of the speaker cabinets 20 is installed the internal space of the suspended ceiling 10. Each of the speaker cabinets 20 is formed of a speaker unit 23 and a casing 25.

Figure 5:
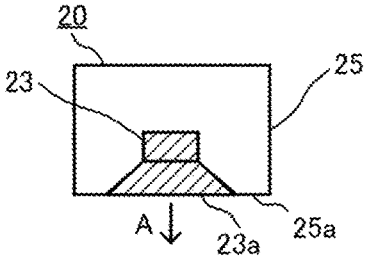
FIG. 5 is a side view showing a configuration of an example of a speaker cabinet 20 according to Embodiment 1.
Figure 6:
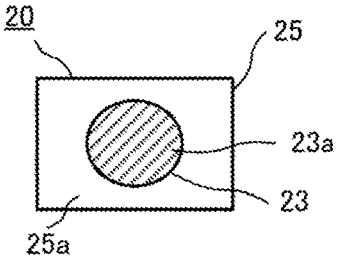
FIG. 6 is a front view of the speaker cabinet 20 of FIG. 5.

FIG. 5 is a side view showing a configuration of an example of a speaker cabinet 20 according to Embodiment 1. FIG. 6 is a front view of the speaker cabinet 20 of FIG. 5. As shown in FIGS. 5 and 6, the speaker unit 23 is accommodated in the casing 25. The speaker unit 23 has provided on a front surface 25*a* of the casing 25 a radiation surface 23*a* that radiates sound. The casing 25 has, for example, a cuboidal shape. The casing 25 is a closed apparatus. The radiation surface 23*a* of the speaker unit 23 is exposed outward through an installation hole provided in the casing 25. Other parts of the speaker unit 23 are all installed inside the casing 25. Accordingly, the sound from the radiation surface 23*a* of the speaker unit 23 is radiated only in the direction of an arrow A in FIG. 5, and is not radiated outward via the other parts of the casing 25 other than the radiation surface 23*a*.

Figure 7:
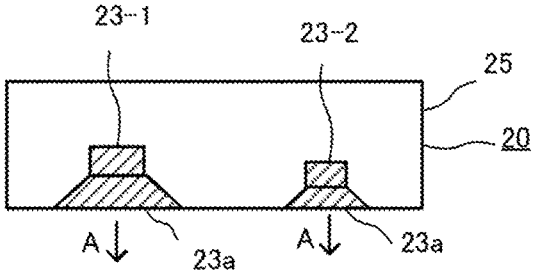
FIG. 7 is a side view showing a configuration of another example of a speaker cabinet 20 according to Embodiment 1.
Figure 8:
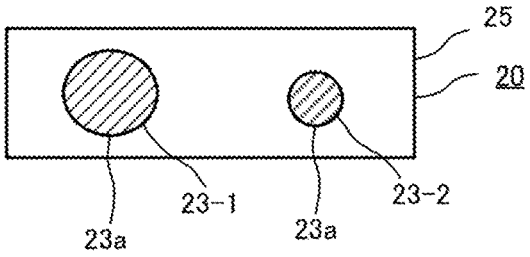
FIG. 8 is a front view of the speaker cabinet 20 of FIG. 7.

FIG. 7 is a side view showing a configuration of another example of a speaker cabinet 20 according to Embodiment 1. FIG. 8 is a front view of the speaker cabinet 20 of FIG. 7. As shown in FIGS. 7 and 8, the speaker cabinet 20 may have two or more speaker units 23 accommodated inside the casing 25. In this case, for example, one speaker unit 23-1 may be a full-range speaker, and the other speaker unit 23-2 may be a tweeter. The term "full-range speaker" means a speaker configured to reproduce a low-to-high range with one speaker. In each of the embodiments of the present disclosure, one speaker unit 23 accommodated inside the casing 25 of a speaker cabinet 20 is a full-range speaker. Further, the term "tweeter" means a speaker dedicated to a low range for use as an aid to a full-range speaker. It is difficult to reproduce a low-to-high range with one speaker, and doing so may result in poor sound quality. In such a case, a tweeter is used to compensate for the poor sound quality. Thus, the two or more speaker units 23 arranged inside the casing 25 may be of different types or may be of the same type. In such a case in which one speaker cabinet 20 includes a plurality of speaker units 23, a feeling of sound quality can be improved and a wider band can be reproduced with the speaker cabinet 20 alone.

Continued reference is made to FIGS. 3 and 4. As shown in FIGS. 3 and 4, the speaker cabinets 20 are arranged in the internal space of the suspended ceiling 10. The height of the suspended ceiling 10 in the Y direction (i.e. the direction parallel with the height of the car 5) is approximately 5 cm. Accordingly, as shown in FIG. 3, the height H1 of the casing 25 of each of the speaker cabinets 20 in the Y direction (i.e. the direction parallel with the height of the car 5) is less than or equal to 5 cm. Further, the radiation surface 23*a* of the speaker unit 23 is disposed to face a side board 5*a* of the car 5. The radiation surface 23*a* is located along an edge of a side surface 10*a* of the suspended ceiling 10. The radiation surface 23*a* is located in the same plane as the side surface 10*a* of the suspended ceiling 10. Accordingly, the position of the radiation surface 23*a* in the X direction (i.e. the direction parallel with the width of the car 5) agrees or substantially agrees with the position of the side surface 10*a* of the suspended ceiling 10 in the X direction. The side surface 10*a* of the suspended ceiling 10 is provided with an opening in alignment with the position of the radiation surface 23*a*. It should be noted that the side surface 10*a* of the suspended ceiling 10 may be entirely in an open state. Accordingly, the sound radiated from the radiation surface 23*a* is not insulated by the side surface 10*a* of the suspended ceiling 10. Further, as mentioned above, there is a gap 11 of the first distance D between the side surface 10*a* of the suspended ceiling 10 and the side board 5*a* of the car 5. The first distance D is approximately 5 cm. As shown in FIGS. 3 and 4, the sound radiated from the radiation surface 23*a* of the speaker unit 23 is radiated in the direction of an arrow A. After that, the sound is reflected off the side board 5*a* of the car 5 to turn into reflected sound. As shown in FIGS. 3 and 4, the reflected sound travels in the directions of arrows B. Thus, according to Embodiment 1, the speaker unit 23 conducts "indirect sound radiation" by which the speaker unit 23 radiates sound to a passenger through the use of reflection off the side board 5*a* of the car 5.

Further, as shown in FIG. 4, each of the speaker cabinets 20 is located in a central portion of the suspended ceiling 10 in the Z direction (i.e. the direction parallel with the depth of the car 5). Further, as shown in FIG. 3, each of the speaker cabinets 20 is located in a central portion of the suspended ceiling 10 in the Y direction (i.e. the direction parallel with the height of the car 5).

The speaker unit 23 provided in one of the two speaker cabinets 20 shown in FIG. 4 is referred to as "speaker unit 23R". Further, the speaker unit 23 provided in an other speaker cabinet 20 is referred to as "speaker unit 23L". The speaker unit 23R and the speaker unit 23L are placed at a clearance from each other. The speaker unit 23R and the speaker unit 23L are arranged so that their respective back surfaces face each other. When described with reference to a passenger model 42 shown in FIG. 4, the radiation surface 23*a* of the speaker unit 23R is disposed to face the right side board 5*a* of the car 5. Meanwhile, the radiation surface 23*a* of the speaker unit 23L is disposed to face the left side board 5*a* of the car 5. Each of the radiation surfaces 23*a* of the speaker units 23R and 23L is disposed to face the gap 11. Each of the radiation surfaces 23*a* of the speaker units 23R and 23L is located in the same plane as a corresponding one of the right and left side surfaces 10*a* of the suspended ceiling 10.

According to Embodiment 1, each of the speaker units 23 reproduces sound pressures lying within a frequency band ranging, for example, from 150 Hz to 48 kHz. That is, sound of a low frequency lower than 150 Hz is not used. A reason for this is explained. The inside of the car 5 is an enclosed space. Therefore, a low-frequency component of a long wavelength is reflected more than once among the side boards 5*a* of the inside of the car 5. This results in a long reflection time, a persistent standing wave, and a long reverberation time. A standing wave generated by the reflection of sound is hereinafter referred to as "echo". Thus, it is harder for a low-frequency sound to become attenuated inside the car 5 than sound radiated in an open space. This results in a low-frequency sound persistently echoing inside the car 5 to cause a passenger unnecessary low-frequency noise that gives the passenger a feeling of unwanted discomfort. Accordingly, Embodiment 1 is required to reproduce a band of frequencies higher than or equal to 150 Hz. This makes it possible to avoid giving the passenger a feeling of discomfort and give the passenger comfort. Further, as for a high-frequency component, a frequency band compatible with 96 kHz/24 bit is rendered reproducible for the purpose of providing high sound quality with high resolution based on a high-resolution sound source. Embodiment 1 assumes a band of frequencies lower than or equal to 48 kHz, which is half as high as 96 kHz/24 bit.

Continued reference is made to FIG. 3. The sound field control device 21 is located inside the car control device 9 provided on the upper surface of the ceiling board 5*c* of the car 5. As shown in FIG. 2, the sound field control device 21 includes the output unit 9*c* and the sound field control unit 9*d*. Further, the sound field control device 21 further includes a power source (not illustrated). The sound field control unit 9*d* is provided with a sound field control substrate.

Figure 9:
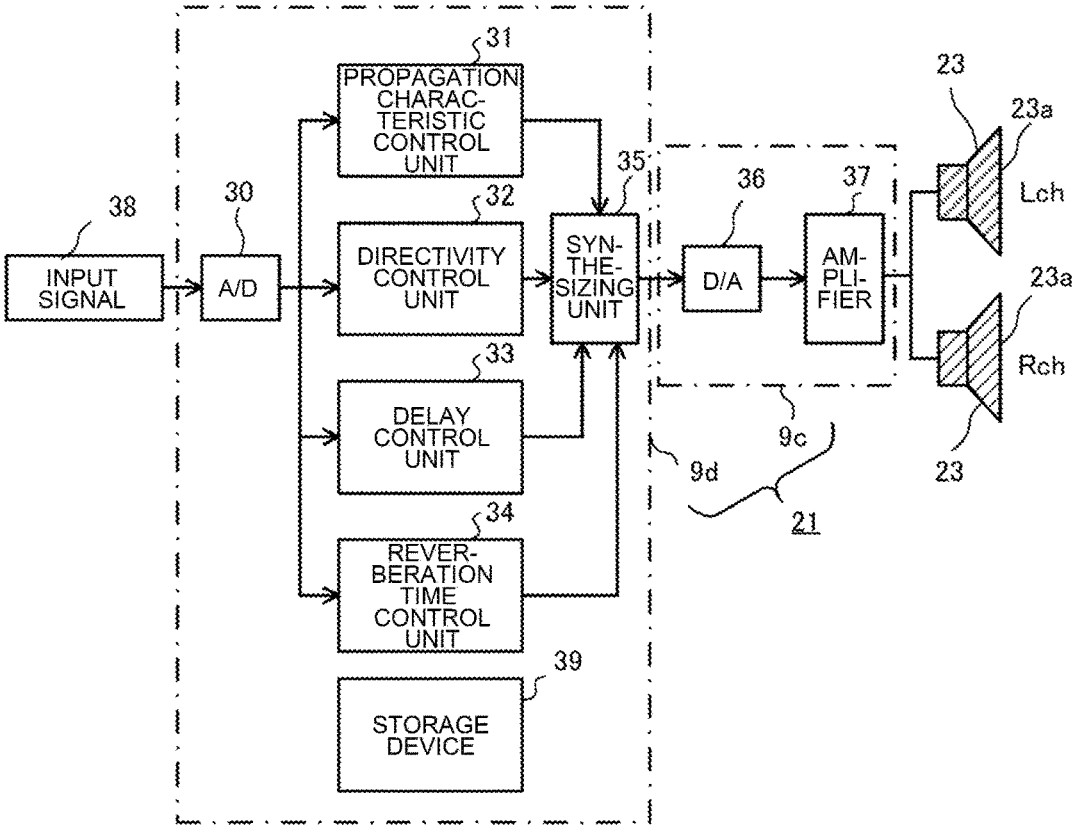
FIG. 9 is a block diagram showing a configuration of a sound field control device 21 according to Embodiment 1.

FIG. 9 is a block diagram showing a configuration of the sound field control device 21 according to Embodiment 1. As mentioned above, the sound field control device 21 includes the output unit 9*c* and the sound field control unit 9*d*.

The output unit 9*c* includes a D/A converter 36 and an amplifier 37. The D/A converter 36 converts a digital signal into an analog signal and outputs the analog signal. The amplifier 37 amplifies the analog signal outputted from the D/A converter 36. The analog signal outputted from the amplifier 37 is transmitted to each of the speaker units 23. The speaker unit 23 radiates the analog signal as sound from the radiation surface 23*a*.

The sound field control unit 9*d* includes an A/D converter 30, a propagation characteristic control unit 31, a directivity control unit 32, a delay control unit 33, a reverberation time control unit 34, a synthesizing unit 35, and a storage device 39. The storage device 39 may be part of the storage unit 9*e* shown in FIG. 2, or may be formed of another memory.

The A/D converter 30 is supplied with an input signal 38 inputted from the input device 22. The input signal 38 is an analog signal. The input signal 38 is the aforementioned sound content. The A/D converter 30 converts the analog signal into a digital signal and outputs the digital signal. The digital signal outputted from the A/D converter 30 is inputted to the propagation characteristic control unit 31, the directivity control unit 32, the delay control unit 33, and the reverberation time control unit 34.

The propagation characteristic control unit 31 conducts time-axis crosstalk phase component control on the digital signal outputted from the A/D converter 30. In the time-axis crosstalk phase component control, a sound radiation component (hereinafter referred to as "cross sound") propagating indirectly to the right and left ears of a passenger is attenuated according to indoor environmental characteristics. This causes a sound field to be expanded. Details will be described later.

The directivity control unit 32 conducts in-phase linear phase control on the digital signal outputted from the A/D converter 30. In the in-phase linear phase control, the direction of sound radiated from the speaker unit 23 at each arbitrary angle is time-axially controlled, whereby in-phase radiated sound is produced. This brings about a surround-sound effect by which the sound can be heard in the same way anywhere inside the car 5. Details will be described later.

The delay control unit 33 conducts linear phase control on the digital signal outputted from the A/D converter 30. In the linear phase control, deterioration in sound quality due to a delay in propagation time at each frequency is eliminated by conducting control so that sounds lying within an entire frequency band simultaneously reach a passenger. Details will be described later.

The reverberation time control unit 34 conduct a control as reverberation time control on the digital signal outputted from the A/D converter 30. The reverberation time control involves control that reduces the reverberation time of an echo produced by reflection. As mentioned above, sound is repeatedly reflected off walls in an enclosed space such as the car 5. This causes the sound to untunefully echo, resulting in poor clarity of sound. Therefore, the reverberation time control involves control that reduces the reverberation time of sound, thereby making the sound heard clearly. Details will be described later.

The synthesizing unit 35 synthesizes digital signals outputted from the propagation characteristic control unit 31, the directivity control unit 32, the delay control unit 33, and the reverberation time control unit 34. A synthesized digital signal outputted from the synthesizing unit 35 is inputted to the aforementioned D/A converter 36.

According to the description given here, the synthesizing unit 35 synthesizes digital signals outputted from the propagation characteristic control unit 31, the directivity control unit 32, the delay control unit 33, and the reverberation time control unit 34. However, this case is not intended to impose any limitation, and the synthesizing unit 35 may not be provided. In that case, the propagation characteristic control unit 31, the directivity control unit 32, the delay control unit 33, and the reverberation time control unit 34 may conduct processes in sequence so that a digital signal outputted from the reverberation time control unit 34 is emitted from the speaker unit 23. Further, it is not always necessary to conduct all processes in the propagation characteristic control unit 31, the directivity control unit 32, the delay control unit 33, and the reverberation time control unit 34. At least one of the processes in the propagation characteristic control unit 31, the directivity control unit 32, the delay control unit 33, and the reverberation time control unit 34 may be conducted on an as-needed basis.

Continued reference is made to FIG. 3. The input device 22 is accommodated inside a hinged door 5*g* provided in a side board 5*a* inside the car 5. Under normal circumstances, the hinged door 5*g* is closed and never touched by a passenger. The input device 22 is provided with a USB connector 22*a* and a volume controller 22*b*. To the USB connector 22*a*, a USB memory having stored therein sound source data representing the sound content is connected. The volume controller 22*b* is operated by a worker to set a volume level.

The audio system 13 generates a sound field 27 ranging as indicated by dotted lines in FIG. 3. Specifically, the height H2 of a lower limit 27*a* of the sound field 27 is for example 1.6 m above the floor board 5*b* of the car 5. Further, the height of an upper limit of the sound field 27 is for example 1.8 m above the floor board 5*b* of the car 5. It is desirable that the sound field 27 be formed so that a height above the floor board 5*b* falls within a range of 1.6 m to 1.8 m. Thus, the sound field 27 is generated in a portion of the inside of the car 5 that is higher than the lower limit 27*a*. This results in causing the sound field 27 to be formed around the head of a passenger as shown in FIG. 3. The range of heights of 1.6 m to 1.8 m above the floor board 5*b* is equivalent to the average positions of the ears of passengers. In a range of heights of 0 m to less than 1.6 m above the floor board 5*b*, a favorable sound field cannot be formed in a case in which a plurality of passengers are riding inside the car 5, as sound is insulated or absorbed by the bodies of the passengers. In a range of heights of over 1.8 m above the floor board 5*b*, a passenger auditorily feels it is hard to hear the sound, as the sound field 27 is unevenly formed over the head of the passenger.

Many common elevators include a speaker configured to give a voice message or an alarm in case of emergency, a speaker configured to notify passengers at which floor the elevator has arrived, and an intercom configured to have outside communications. Some models of elevators reproduce music through a speaker for an intercom for the comfort of passengers. However, there are only a few elevators configured to reproduce music, and in most cases, such elevators are mounted with only one speaker as a requisite minimum number of speakers. Under the prevailing conditions, almost no elevators actively provide comfort to passengers inside the car.

Even if music is provided inside the car, the music is sent out through the diversion of a speaker of an intercom. The speaker of the intercom is usually placed in an operation panel inside the car. Due to limitations of space inside the operation panel, the speaker of the intercom is required to have features such as light weight, low profile, small size, and monaural reproduction. Accordingly, reproduced sound from the speaker of the intercom is very poor in sound quality, and such radiated sound is clearly different from that of music being reproduced by a household audio device.

Further, most elevator users experience "awkwardness" because they ride with someone they do not know and they are confined in a small space. This undesirably causes the space inside the car to be a space that is not comfortable for the passengers to be in.

On the other hand, conversion to high-rise buildings leads to an increase in the duration of a ride in an elevator, and in many cases, the duration of a ride is longer than or equal to 1 minute.

Against this background, the audio system 13 according to Embodiment 1 is intended for elevator users to use elevators without constraint, and is intended to provide a comfortable space inside the car 5 during use. Specifically, the audio system 13 provides a stereoscopic sound space such as a movie theater so that passengers inside the car 5 can feel that the inside of the car 5 is a large space such as an open field. The audio system 13 provides passengers inside the car 5 with a "realistic feeling of being in a large and comfortable space" so that they feel as if a small space were a large space. This allows elevator users to use elevators with a good feeling.

Further, the audio system 13 uses two speaker units 23 to provide a realistic feeling of being in a large and comfortable space. The audio system 13 achieves high-quality sound reproduction with a reduced number of speaker units 23.

Preconditions inside the car 5 are set up here. Although it is assumed that as described with reference to FIGS. 1 and 2, there is a minimum of one car door 5*d*, most passengers stand facing the car door 5*d*. According to various theories, passengers face in that direction because they find an exit of the car 5 in that direction. This behavior of passengers is advantageous to sound environments. That is, since most passengers are facing in one direction, a stereo environment can be naturally created simply by installing speaker units 23 on the right and left sides with the car door 5*d* at the center.

[Propagation Characteristic Control Unit 31]

The propagation characteristic control unit 31 is described. The propagation characteristic control unit 31 controls, based on a difference in propagation time between a direct sound arriving at one of a pair of virtual microphones 40 and a cross sound arriving at the other of the pair of virtual microphones 40 when a sound wave radiated from the radiation surface 23*a* of each of the speaker units 23 arrives at the pair of virtual microphones 40, the propagation characteristic of the sound wave.

Figure 10:
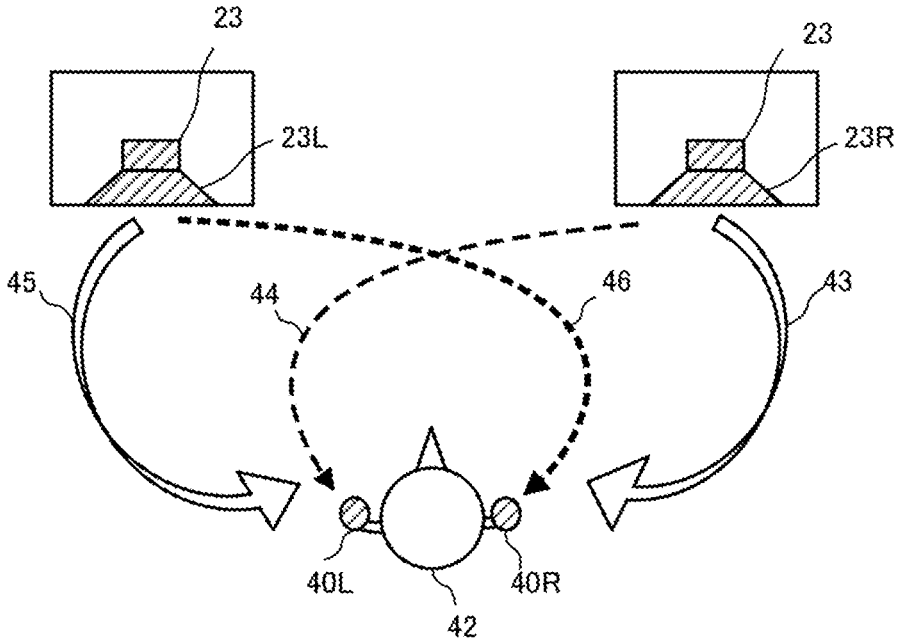
FIG. 10 is a top view showing a model of a relationship between speaker units 23 and microphones 40 in the audio system 13 according to Embodiment 1.

First, the principle of control that is executed by the propagation characteristic control unit 31 is illustrated. FIG. 10 is a top view showing a model of a relationship between the speaker units 23 and the microphones 40 in the audio system 13 according to Embodiment 1. In FIG. 10, the passenger model 42 is a life-size model of an ordinary passenger. A microphone 40R is installed in the right ear of the passenger model 42, and a microphone 40L is installed in the left ear of the passenger model 42. Further, as shown in FIG. 3, additional microphones 41R and 41L may be further installed above the microphones 40R and 40L, respectively, if necessary. For ease of explanation, the following gives a description by taking, as an example, a case in which only the microphones 40R and 40L are installed. In the model shown in FIG. 10, the speaker unit 23 installed on the right front side of the passenger model 42 is referred to as "speaker unit 23R". Similarly, the speaker unit 23 installed on the left front side of the passenger model 42 is referred to as "speaker unit 23L".

At this point in time, sound radiated from the speaker unit 23R turns into a direct sound R (reference sign 43) and a cross sound RL (reference sign 44) that arrive at the microphones 40R and 40L, respectively. That is, the direct sound R (reference sign 43) is a direct sound arriving at the microphone 40R after propagating for a given period of time from the speaker unit 23R. Further, the cross sound RL (reference sign 44) is an indirect sound arriving at the microphone 40L after propagating for a given period of time from the speaker unit 23R.

Similarly, sound radiated from the speaker unit 23L turns into a direct sound L (reference sign 45) and a cross sound LR (reference sign 46) that arrive at the microphones 40L and 40R, respectively.

Figure 11:
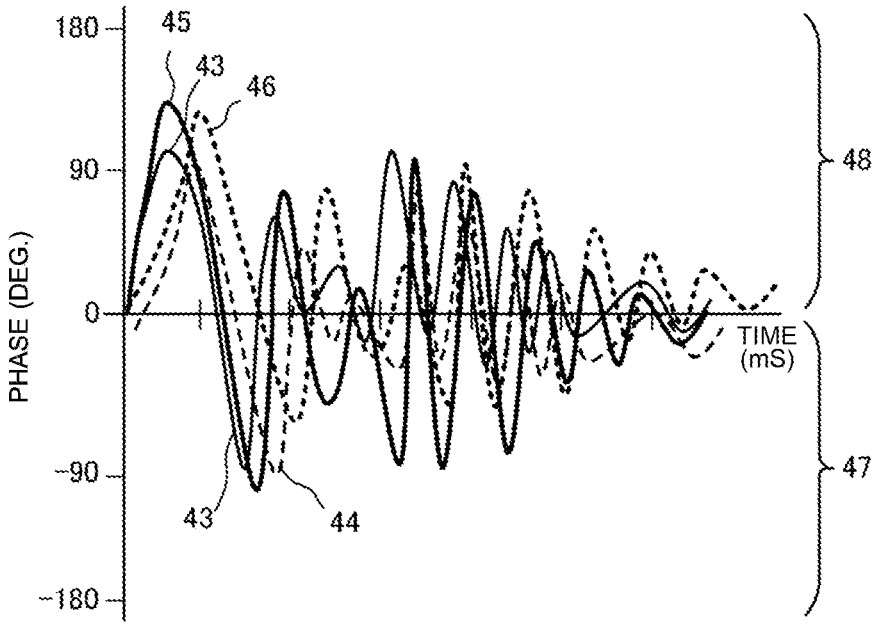
FIG. 11 is a diagram showing the waveforms of direct sounds and cross sounds according to Embodiment 1.

FIG. 11 is a diagram showing the waveforms of direct sounds and cross sounds according to Embodiment 1. FIG. 11 shows the waveforms of the direct sound R (reference sign 43) received by the microphone 40R, the direct sound L (reference sign 45) received by the microphone 40L, the cross sound RL (reference sign 44) received by the microphone 40L, and the cross sound LR (reference sign 46) received by the microphone 40R. In FIG. 11, the horizontal axis represents time, and the vertical axis represents phase. As can be seen from FIG. 11, these four sounds arrive at different times.

Figure 12:
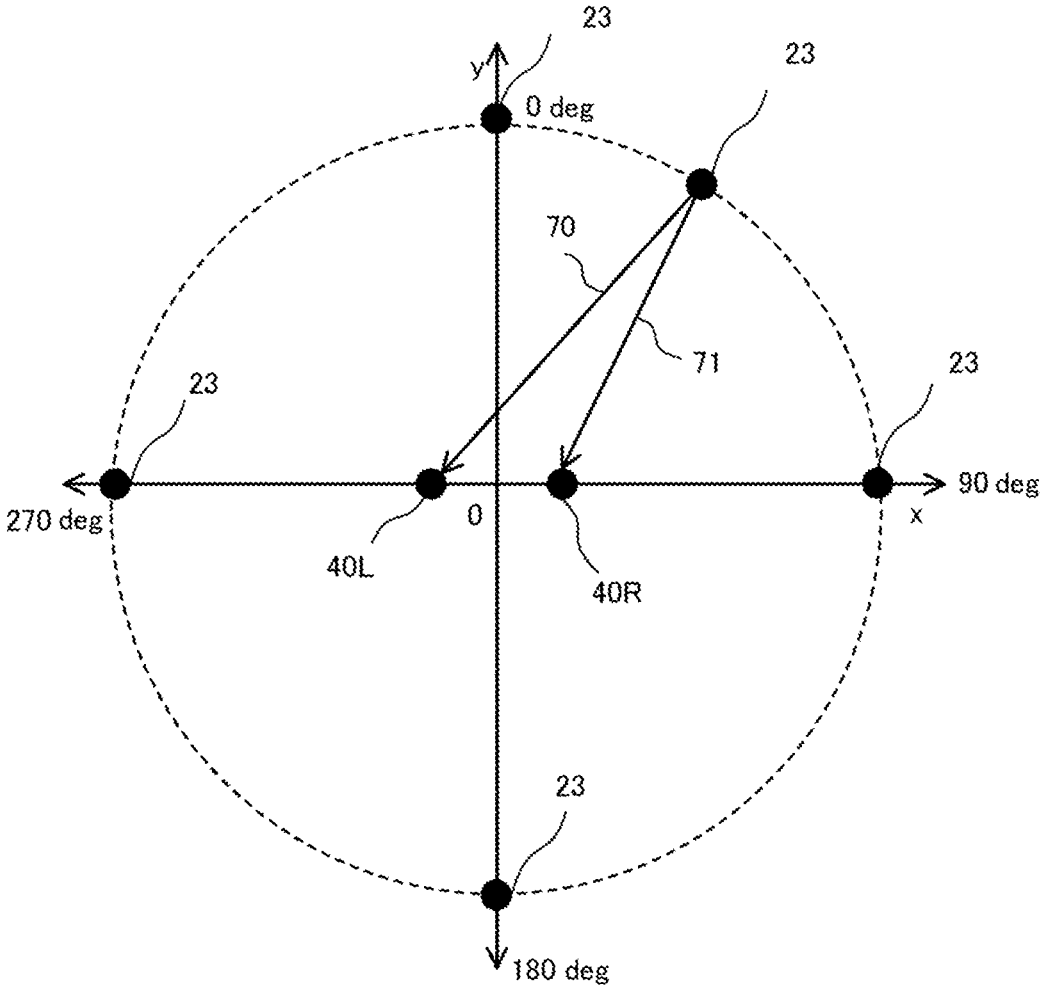
FIG. 12 is a top view showing a model of a relationship between the speaker units 23 and the microphones 40.

This is explained in more detail. FIG. 12 is a top view showing a model of a relationship between the speaker units 23 and the microphones 40. For clear explanations, FIG. 12 shows a case in which sound is being radiated from any one of the plurality of speaker units 23. In the model shown in FIG. 12, the microphones 40R and 40L are placed at a constant distance from each other on the x axis with the origin at the center. Further, the plurality of speaker units 23 are arranged on the circumference of a circle centered at the origin. The position of each of the speaker units 23 is identified by an angle with the positive direction of the y axis being 0 deg. and the positive direction of the x axis being 90 deg.

Let it be assumed that Y1 is the propagation time it takes for a sound wave 70 to propagate from the speaker unit 23 to the microphone 40L and Y2 is the propagation time it takes for a sound wave 71 to propagate from the speaker unit 23 to the microphone 40R, with the speed of sound being 340 m/s. At this point in time, the sound wave 70 arrives at the microphone 40L with a delay time (Y1-Y2).

However, in the case of a speaker unit 23 located at 0 deg. or located at 180 deg., a sound wave from the speaker unit 23 arrives at the microphones 40R and 40L at the same point in time, so that the delay time (Y1-Y2) is equal to 0.

Meanwhile, in the case of a speaker unit 23 located at 90 deg. or located at 270 deg., the delay time (Y1-Y2) reaches its maximum. That is, in the case of a speaker unit 23 located at 90 deg., a sound wave arrives at the microphone 40R fastest but arrives at the microphone 40L latest. Further, in the case of a speaker unit 23 located at 270 deg., a sound wave arrives at the microphone 40L fastest but arrives at the microphone 40R latest.

Thus, the delay time (Y1-Y2) varies from the position of one speaker unit 23 to the position of another speaker unit 23. Accordingly, the delay time (Y1-Y2) can be measured in advance for each of the positions of the speaker units 23 by sending out test sound through the speaker unit 23. Moreover, by the delay time (Y1-Y2) thus measured, the waveform of the sound wave 71 arriving at the microphone 40R is made later than the waveform of the sound wave 70 arriving at the microphone 40L. This allows the waveform of the sound wave 70 arriving at the microphone 40L and the waveform of the sound wave 71 arriving at the microphone 40R to coincide with each other regardless of the position of the speaker unit 23.

Figure 13:
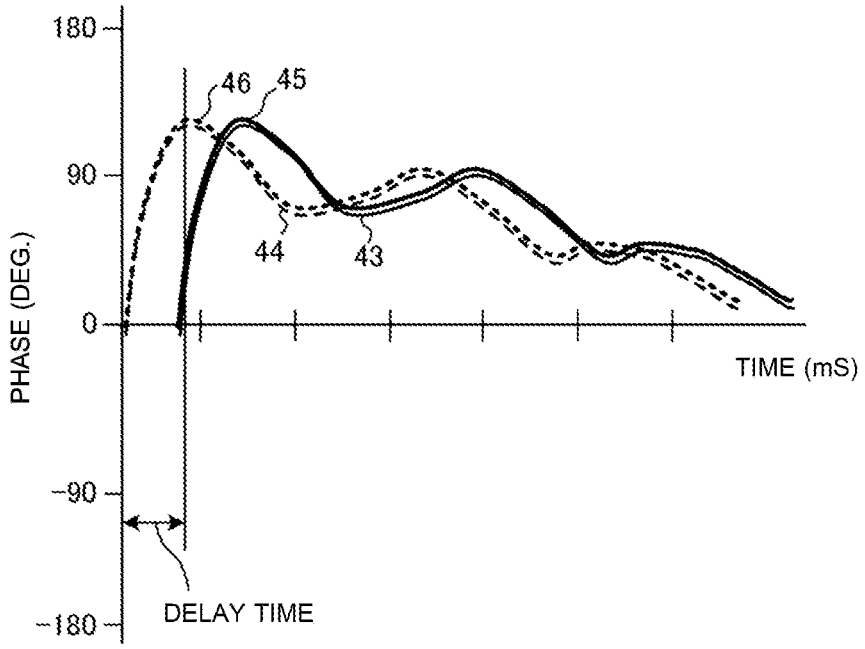
FIG. 13 is a diagram showing the waveforms of sound waves outputted from a propagation characteristic control unit 31 provided in the audio system 13 according to Embodiment 1.

The propagation characteristic control unit 31 utilizes this principle to conduct the following process to obtain four waveforms shown in FIG. 13 from the four waveforms shown in FIG. 11. FIG. 13 is a diagram showing the waveforms of sound waves outputted from the propagation characteristic control unit 31 provided in the audio system 13 according to Embodiment 1. In FIG. 13, the horizontal axis represents time, and the vertical axis represents phase.

First, two speaker units 23 are installed in position as shown in FIG. 4. Next, the passenger model 42 is installed inside the car 5. The microphone 40R is installed in the right ear of the passenger model 42, and the microphone 40L is installed in the left ear of the passenger model 42.

Next, a binaural measurement is conducted by sending out test sound through the two speaker units 23 installed in position as shown in FIG. 4 and receiving the test sound with the microphones 40R and 40L. In the binaural measurement, direct sounds and cross sounds are measured separately in the form of differences in propagation time. The test sound used here is white noise an entire frequency band of which has been subjected to signal processing at the same sound pressure level. As shown in FIG. 4, the speaker unit 23 on the right side of the passenger model 42 is referred to as "speaker unit 23R", and the speaker unit 23 on the left side of the passenger model 42 is referred to as "speaker unit 23L". The test sound is reproduced from the speaker units 23 in the order of the speaker unit 23R alone, the speaker unit 23L alone, and then both the speaker units 23R and 23L. Thus, in a case in which the number of speaker units 23 is 2, the test sound is sequentially reproduced from one or the other of the two speaker units 23 and then simultaneously reproduced from both of the two speaker units 23. This reproduction makes it possible to acquire information on radiation characteristics observed inside the car 5 when the test sound is radiated separately from each speaker unit 23 and information on radiation characteristics observed inside the car 5 when the test sound is radiated simultaneously from all speaker units 23.

Reproducing the test sound inside the car 5 in this way gives the four waveforms 43 to 46 of sound waves of FIG. 11. Further, a delay time of the cross sound RL (reference sign 44) with respect to the direct sound R (reference sign 43) is calculated based on these four waveforms 43 to 46 of sound waves. This delay time is referred to as "first delay time". Similarly, a delay time of the cross sound LR (reference sign 46) with respect to the direct sound L (reference sign 45) is calculated based on these four waveforms 43 to 46 of sound waves. This delay time is referred to as "second delay time". The first delay time and the second delay time are stored in a storage device (not illustrated) of the audio system 13.

Next, the propagation characteristic control unit 31 calculates the absolute value of a negative phase component 47 of the direct sound R (reference sign 43) shown in FIG. 11 and adds the absolute value to a positive phase component 48 of the direct sound R (reference sign 43). Similarly, the propagation characteristic control unit 31 calculates the absolute value of a negative phase component 47 of the direct sound L (reference sign 45) and adds the absolute value to a positive phase component 48 of the direct sound L (reference sign 45). Further, the propagation characteristic control unit 31 also conducts similar processes on the cross sound RL (reference sign 44) and the cross sound LR (reference sign 46).

Furthermore, the propagation characteristic control unit 31 controls the amplitude and phases of the waveform of the direct sound R (reference sign 43) and the direct sound L (reference sign 45) and thereby makes the waveforms uniform in amplitude and phase. Furthermore, the propagation characteristic control unit 31 controls the amplitude and phases of the waveform of the cross sound RL (reference sign 44) and the cross sound LR (reference sign 46) and thereby makes the waveforms uniform in amplitude and phase. Further, in FIG. 11, a comparison between the direct sound R (reference sign 43) received by the microphone 40R and the cross sound RL (reference sign 44) received by the microphone 40L shows that there is not only a difference in propagation time but also a clear difference in sound pressure level. Similarly, in FIG. 11, a comparison between the direct sound L (reference sign 45) and the cross sound LR (reference sign 46) shows that there is not only a difference in propagation time but also a clear difference in sound pressure level. Accordingly, the propagation characteristic control unit 31 conducts control that makes the waveform of the direct sound R (reference sign 43) and the cross sound RL (reference sign 44) uniform in amplitude. Similarly, the propagation characteristic control unit 31 conducts control that makes the waveform of the direct sound L (reference sign 45) and the cross sound LR (reference sign 46) uniform in amplitude.

Then, the waveform of the direct sound R (reference sign 43) is made later than the waveform of the cross sound RL (reference sign 44) by the first delay time. Similarly, the waveform of the direct sound L (reference sign 45) is made later than the waveform of the cross sound LR (reference sign 46) by the second delay time. This gives four waveforms of FIG. 13. In FIG. 13, the cross sound RL (reference sign 44) and the cross sound LR (reference sign 46) are radiated earlier. After that, the direct sound R (reference sign 43) and the direct sound L (reference sign 45) are radiated the first delay time and the second delay time later, respectively.

A component of cross sound causes a sound image of sound radiated from the speaker units 23 to be heard intensively in the center of the cross component, that is, in between the right and left ears of a passenger. For the radiated sound to give the auditory illusion that the small space inside the car 5 is a large space, it is necessary to let the passenger hear the radiated sound as if the sound image were spreading. For this purpose, it is necessary to radiate the sound with a time difference between a direct sound and a cross sound. The cross sound is radiated first, and then the direct sound is radiated with a time difference. Phase characteristics accompanying the sound radiation of the cross sound and the direct sound need to be made uniform so that the phase characteristics never become opposite in phase. For that purpose, the propagation characteristic control unit 31 makes a phase adjustment. This makes it possible to give the passenger a feeling of migration of sound with the cross sound radiated earlier and give the passenger a feeling of localization of sound with the direct sound radiated later. This results in enabling the passenger to, without feeling a sense of incongruity as if the sound field passed only over the head of the passenger, hear the sound radiated with the feeling of migration and the feeling of localization obtained from the uniform phase.

Thus, the propagation characteristic control unit 31 stores the first delay time and the second delay time in advance in the storage device 39. The propagation characteristic control unit 31 causes the direct sound R (reference sign 43) and the direct sound L (reference sign 45) to be radiated later than the cross sound RL (reference sign 44) and the cross sound LR (reference sign 46) the first delay time and the second delay time, respectively. The propagation characteristic control unit 31 uses filter processes such as FIR (finite impulse response) and IIR (infinite impulse response) as the processes for making amplitude and phases uniform and the processes for delaying the timing of radiation. This makes it possible to generate the sound field 27 inside the car 5 with a feeling of high sound quality.

The passenger model 42 is temporarily installed for testing. Therefore, the passenger model 42 is removed during actual operation of the elevator 1. Accordingly, the microphones 40R and 40L too are removed during actual operation of the elevator 1. Accordingly, the terms such as "propagation time" and "delay time" in the foregoing description refer to times based on the assumption that the microphones 40R and 40L are installed. Therefore, during actual operation, the "propagation time" and the "delay time" are for virtual microphones.

[Directivity Control Unit 32]

The directivity control unit 32 is described. The directivity control unit 32 time-axially controls, for each angle according to the orientation of a passenger, the direction of sound radiated from each of the speaker units 23 and thereby produces in-phase radiated sound. This brings about a surround-sound effect by which the sound can be heard in the same way anywhere inside the car 5. That is, the directivity control unit 32 controls, based on the angle of radiation of a sound wave radiated from the radiation surface 23*a* of the speaker unit 23, the directivity of the sound wave.

First, the principle of in-phase linear phase control that is conducted in the directivity control unit 32 is illustrated. In general, faithful transmission of a signal requires so-called linear phase characteristics according to which the phase characteristics of the signal linearly change with frequency. To achieve linear phase characteristics, linear phase circuits are commonly used. The directivity control unit 32 too uses a linear phase circuit to achieve linear phase characteristics. Note, however, that the directivity control unit 32 uses, for example, a delay circuit in addition to the linear phase circuit to time-axially control, for each angle of radiation of a sound wave, the direction of sound radiated from the speaker unit 23.

Figure 14:
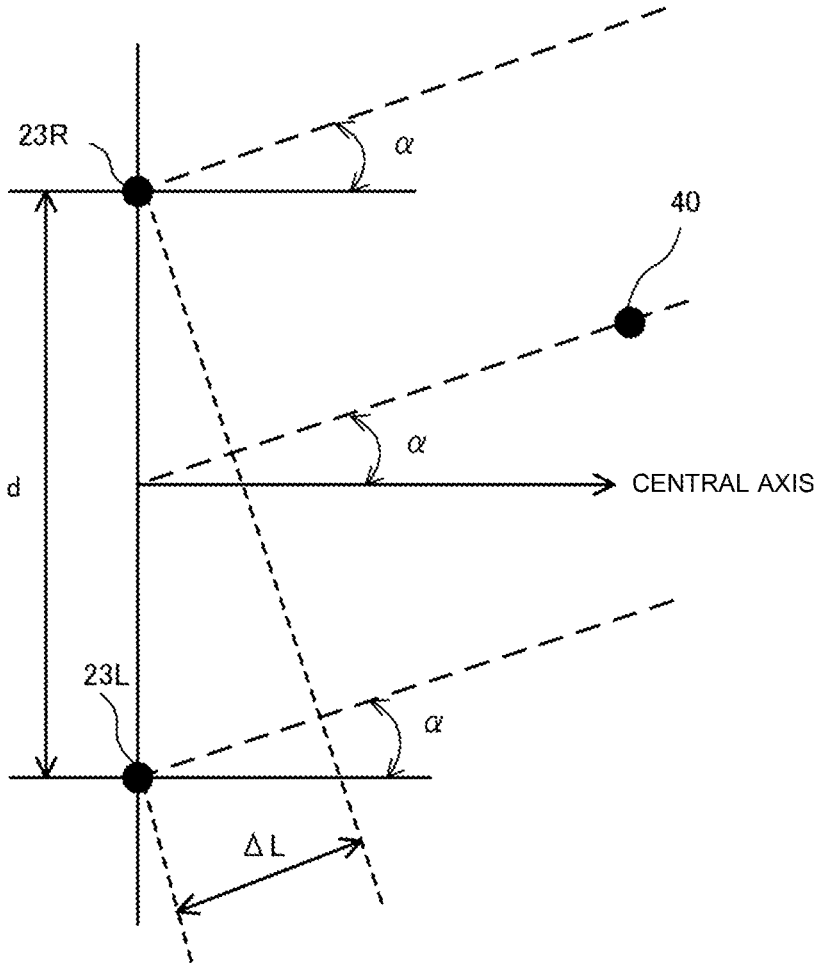
FIG. 14 is a model diagram showing a case in which two speaker units 23R and 23L are placed at a constant distance d from each other.

FIG. 14 is a model diagram showing a case in which the two speaker units 23R and 23L are placed at a constant distance d from each other. In FIG. 14, the angle $\alpha$ is an angle of inclination of a microphone 40 with respect to the central axis of the speaker units 23. At this point in time, the distance difference $\Delta L$ between the distance between the speaker unit 23R and the microphone 40 and the distance between the speaker unit 23L and the microphone 40 is calculated by $\Delta L = d \sin \alpha$. The distance difference $\Delta L$ affects a sound radiation pattern as a phase difference. Therefore, the phase difference $\Delta\varphi$ between sound pressures from the speaker units 23R and 23L is expressed as $\Delta\varphi = \varphi_R - \varphi_L + 360$ deg.$\times d \times \sin \alpha / \lambda$, where $\lambda$ is a wavelength, $\varphi_R$ is the phase of the speaker unit 23R, and $\varphi_L$ is the phase of the speaker unit 23L. At this point in time, a portion in which the sound pressures are added together to be a maximum and a portion in which the sound pressures cancel each other out to be a minimum are produced, with the result that a sound radiation pattern of a synthetic sound pressure 72 such as that shown in FIG. 15 is obtained.

Figure 15:
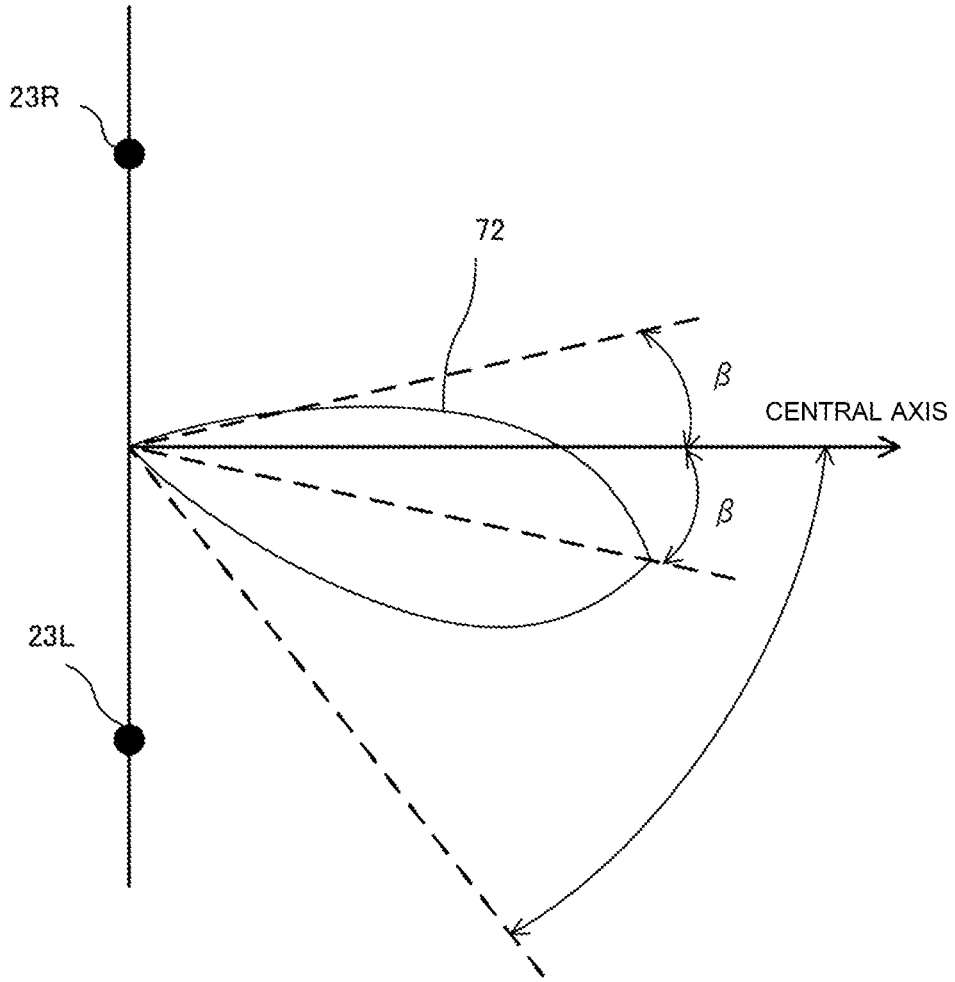
FIG. 15 is a model diagram showing a sound radiation pattern of a synthetic sound pressure 72 formed of the two speaker units 23R and 23L.

FIG. 15 is a model diagram showing a sound radiation pattern of a synthetic sound pressure 72 formed by the two speaker units 23R and 23L. As is clear from FIG. 15, the synthetic sound pressure 72 has a peak direction displaced toward the speaker unit 23L by an angle $\beta$ from the central axis. Assuming that a microphone 40 is installed in position as shown in FIG. 14, the synthetic sound pressure 72 becomes inappropriate in sound radiation direction, so that optimum sound reproduction cannot be achieved.

To address this problem, the directivity control unit 32 time-axially controls the direction of sound radiated from each of the speaker units 23R and 23L and thereby creates in-phase radiated sound. For that purpose, the directivity control unit 32 sends out test sound through the speaker units 23R and 23L with varying angles of the microphone 40. Then, the directivity control unit 32 measures the direction of radiated sound at each angle. The test sound involves the use of an impulse response.

Figure 16:
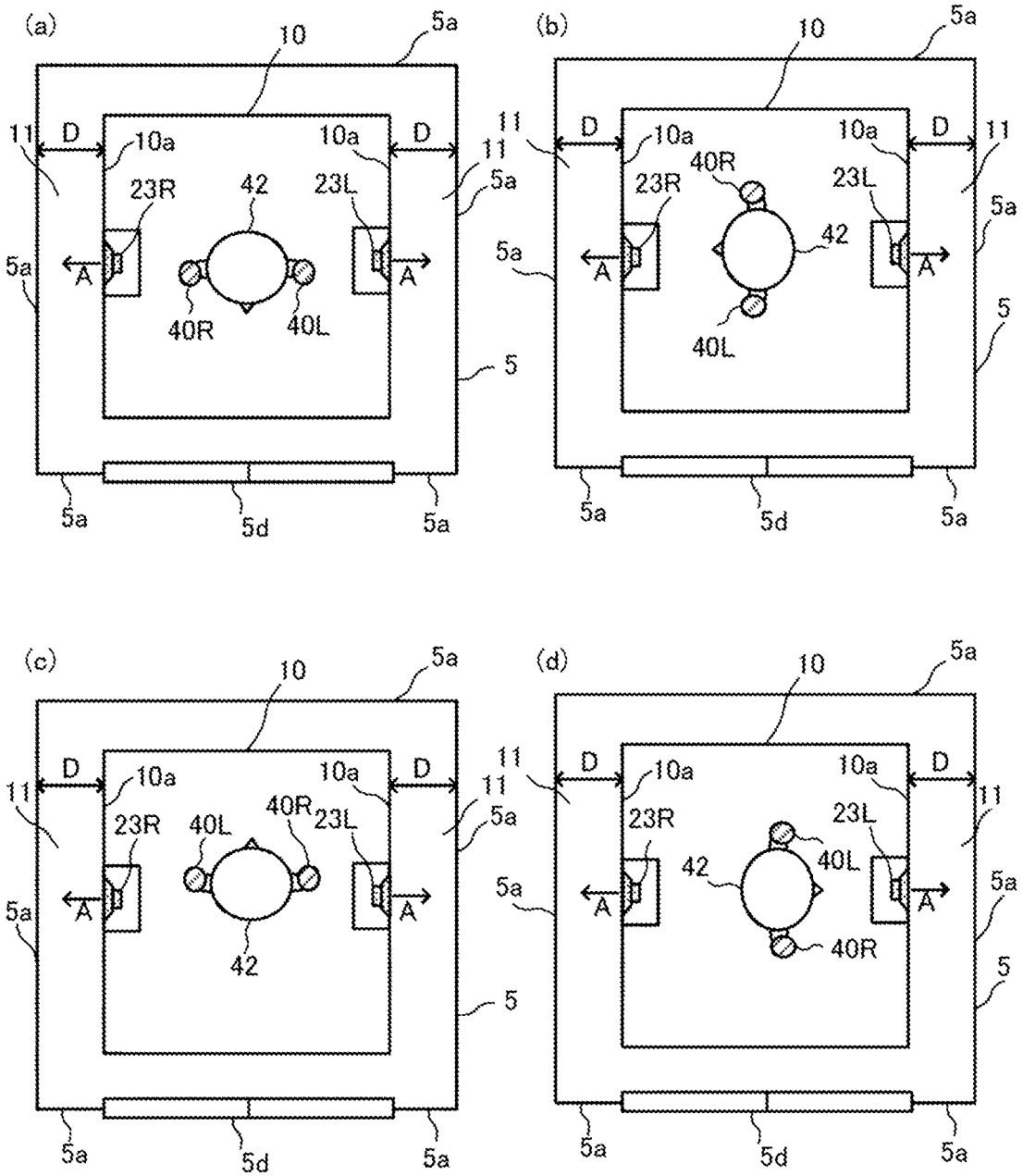
FIG. 16 is a diagram showing a state in which test sound is sent out by a directivity control unit 32 provided in the audio system 13 according to Embodiment 1.

FIG. 16 is a diagram showing a state in which test sound is sent out by the directivity control unit 32 provided in the audio system 13 according to Embodiment 1. As shown in (a) to (d) of FIG. 16, the passenger model 42 is fitted with the microphones 40R and 40L. The passenger model 42, fitted with the microphones 40R and 40L, is rotated in 90-degree increments as shown in (a) to (d) of FIG. 16. In this way, test sound radiated from the speaker units 23R and 23L is measured with the microphone 40R and 40L in the four states shown in (a) to (d) of FIG. 16. Further, without being bound by these four states, the test sound may be measured with the passenger model 42 installed at a different directivity angle other than those of (a) to (d) of FIG. 16.

Figure 17:
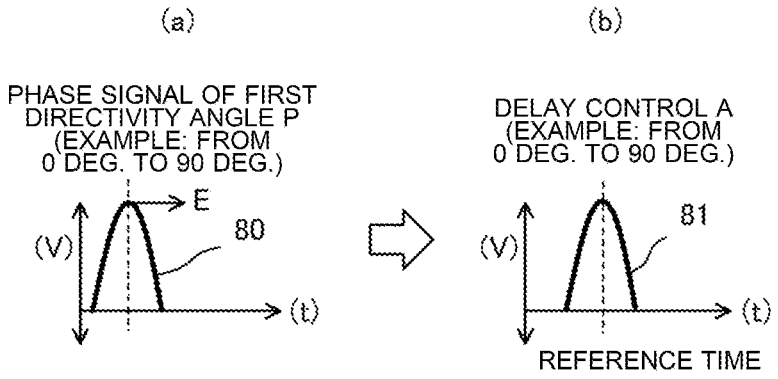
FIG. 17 is a diagram showing phase signals of a first directivity angle P before and after control by the directivity control unit 32 according to Embodiment 1.

The directivity control unit 32 stores results of the measurements in advance in the storage device 39 separately for each directivity angle and time-axially controls the phase for each directivity angle based on the results of the measurements. FIG. 17 is a diagram showing phase signals of a first directivity angle P before and after control by the directivity control unit 32 according to Embodiment 1. (a) of FIG. 17 shows a phase signal 80 before control, and (b) of FIG. 17 shows a phase signal 81 after control. FIG. 17 takes a case of 0 deg. to 90 deg. as an example. In FIG. 17, the horizontal axis represents time, and the vertical axis presents the voltages of the phase signals. The directivity control unit 32 converts the phase signal 80 shown in (a) of FIG. 17 into the phase signal 81 shown in (b) of FIG. 17 by shifting the phase signal 80 shown in (a) of FIG. 17 by a particular delay time as indicated by an arrow E. Specifically, the directivity control unit 32 delays the peak time of the phase signal 80 shown in (a) of FIG. 17 so that the peak time coincides with a reference time shown in (b) of FIG. 17. It should be noted that this particular delay time is a period of time determined for each directivity angle based on the results of the measurements of the test sound shown in (a) to (d) of FIG. 16 described above. Further, the delaying processes involves the use of, for example, a delay circuit 52 (see FIG. 19).

Figure 18:
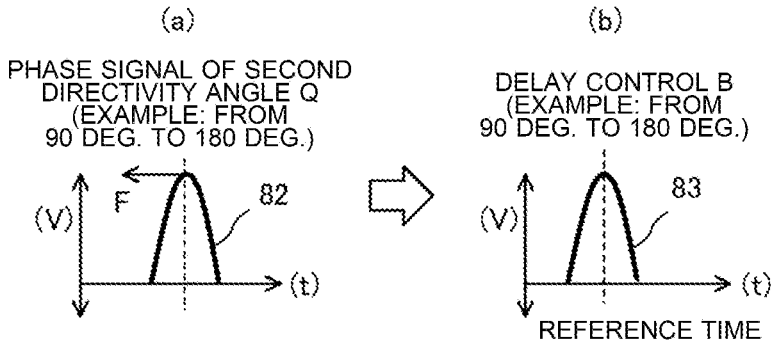
FIG. 18 is a diagram showing phase signals of a second directivity angle Q before and after control by the directivity control unit 32 according to Embodiment 1.

FIG. 18 is a diagram showing phase signals of a second directivity angle Q before and after control by the directivity control unit 32 according to Embodiment 1. (a) of FIG. 18 shows a phase signal 82 before control, and (b) of FIG. 18 shows a phase signal 83 after control. FIG. 18 takes a case of 90 deg. to 180 deg. as an example. In FIG. 18, the horizontal axis represents time, and the vertical axis presents the voltages of the phase signals. The directivity control unit 32 converts the phase signal 82 shown in (a) of FIG. 18 into the phase signal 83 shown in (b) of FIG. 18 by shifting the phase signal 82 shown in (a) of FIG. 18 by a particular delay time as indicated by an arrow F. Note, however, that in the example shown in FIG. 18, a shift is made in a time-axially negative direction as indicated by the arrow F as a result of a delay by the particular delay time. Accordingly, specifically, the directivity control unit 32 hastens the peak time of the phase signal 82 shown in (a) of FIG. 18 by a period of time equivalent to the particular delay time so that the peak time coincides with a reference time shown in (b) of FIG. 18. It should be noted that this particular delay time is a period of time determined for each angle based on the results of the measurements of the test sound shown in (a) to (d) of FIG. 16 described above.

A comparison between the phase signal 81 after control of (b) of FIG. 17 and the phase signal 83 after control of (b) of FIG. 18 shows that the peak times of the two phase signals 81 and 83 both coincide with the reference time. In this way, the directivity control unit 32 conducts controls that, based on an angle formed by the direction of directivity of a sound wave radiated from the radiation surface 23*a* of the speaker unit 23 and the direction of installation of a microphone 40, causes the peak time of a sound pressure of the sound wave to coincide with a reference time. This brings about a surround-sound effect by which the sound can be heard in the same way anywhere inside the car 5. It should be noted here that although, in the description here, the directivity control unit 32 causes the peak times of all phase signals to coincide with the reference time, this case is not intended to impose any limitation. For example, the directivity control unit 32 may cause one of the peak times to coincide with the other of the peak times. That is, for example, the directivity control unit 32 may cause the peak time of the phase signal 80 of (a) of FIG. 17 to coincide with the peak time of the phase signal 82 of (a) of FIG. 18.

Figure 19:
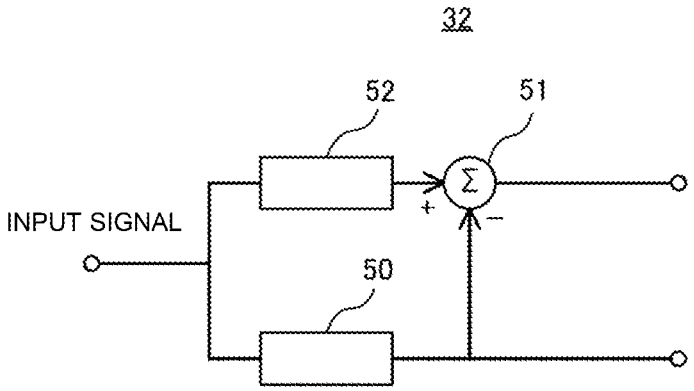
FIG. 19 is a diagram showing an example of a configuration of the directivity control unit 32 according to Embodiment 1.

FIG. 19 is a diagram showing an example of a configuration of the directivity control unit 32 according to Embodiment 1. As shown in FIG. 19, the linear phase circuit is formed of a low-pass filter 50 and a subtracter 51. As shown in FIG. 19, an input signal is divided into two signals. One of the two signals is outputted through the low-pass filter 50. The other of the two signals is inputted to the subtracter 51. The subtracter 51 subtracts, from the signal inputted to the subtracter 51, the signal having passed through the low-pass filter 50. This is a basic operation of the linear phase circuit. As shown in FIG. 19, the directivity control unit 32 includes the delay circuit 52 in addition to the linear phase circuit. The delay circuit 52 delays a signal by a delay time at each angle determined by the directivity control unit 32 and outputs the signal.

[Delay Control Unit 33]

The delay control unit 33 is described. To eliminate deterioration in sound quality due to a delay in propagation time at each frequency, the delay control unit 33 conducts linear phase control so that sounds of all frequencies simultaneously reach a passenger. That is, the delay control unit 33 controls a delay in propagation time derived from the frequency of a sound wave radiated from the radiation surface 23*a* of each of the speaker units 23. Specifically, the delay control unit 33 stores propagation times in advance in the storage device 39 separately for each of the frequencies of sound waves. When sound waves of a plurality of frequencies are radiated from the radiation surface 23*a*, the delay control unit 33 controls the timing of radiation of those sound waves based on the propagation time of the sound wave at each frequency so that the peaks of the phases of the sound waves of the plurality of frequencies coincide.

It is known that sound varies in propagation time from one frequency to another.

Figure 20:
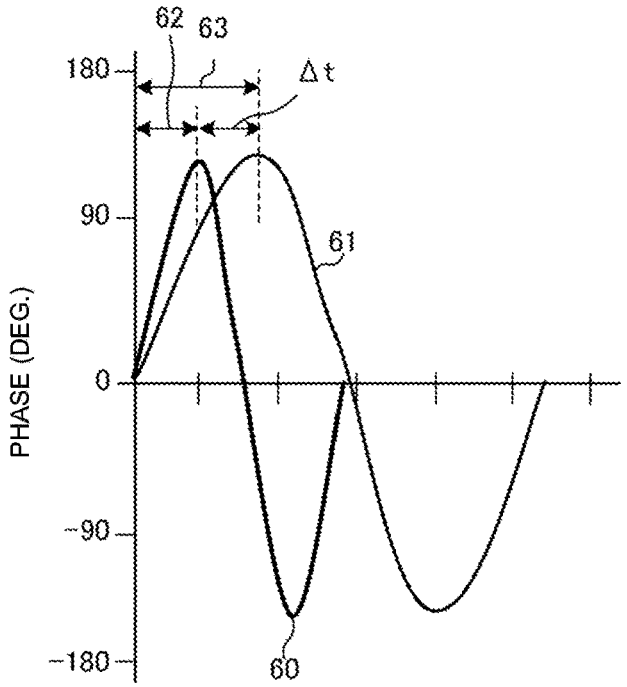
FIG. 20 is a diagram showing the waveforms of sounds received by a microphone 40R or 40L according to Embodiment 1.

FIG. 20 is a diagram showing the waveforms of sounds received by the microphone 40R or 40L according to Embodiment 1. In FIG. 20, the horizontal axis represents time, and the vertical axis represents phase. As shown in FIG. 20, a waveform 61 of a sound with a frequency of 500 Hz arrives at the microphone 40 later than a waveform 60 of a sound with a frequency of 1 kHz. That is, a propagation time 62 of the waveform 60 is shorter than a propagation time 63 of the waveform 61.

Figure 21:
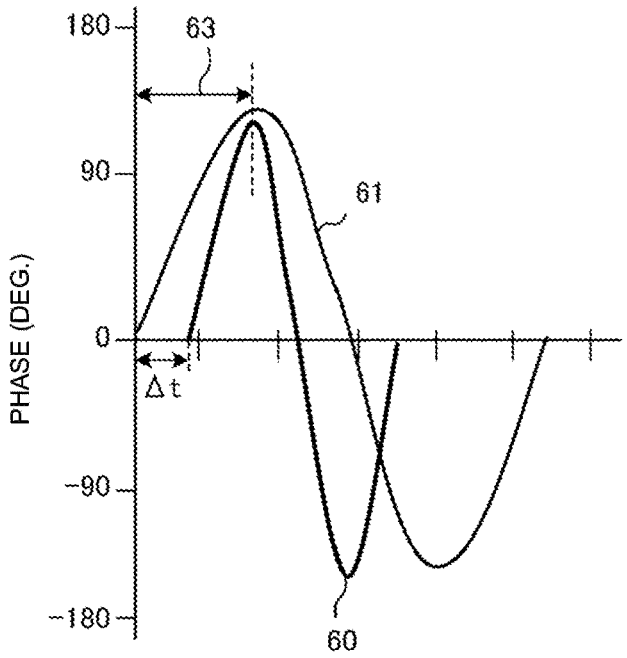
FIG. 21 is a diagram showing waveforms outputted from a delay control unit 33 according to Embodiment 1.

By sending out test sound through the speaker unit 23 and receiving the test sound through the microphone 40, the delay control unit 33 measures the propagation time of the sound at each frequency and stores the propagation time in advance in the storage device 39. For all sounds of different frequencies to simultaneously reach, the delay control unit 33 conducts control so that the propagation times of those sounds coincide. Specifically, the delay control unit 33 emits the sound of the waveform 60 the speaker unit 23 with a delay by a time difference Δt between the propagation time 63 and the propagation time 62. This results in causing the waveforms 60 and 61 to reach their respective peak values at the same point in time as shown in FIG. 21. FIG. 21 is a diagram showing waveforms outputted from the delay control unit 33 according to Embodiment 1.

The delay control unit 33 conducts the following process to obtain the two waveforms shown in FIG. 21 from the two waveforms of FIG. 20.

First, two speaker units 23 are installed in position as shown in FIG. 4. The delay control unit 33 sends out test sound through the speaker units 23 and receives the test sound through the microphones 40R and 40L. As the test sound, white noise is used. The delay control unit 33 varies the frequency of the sound in sequence at regular intervals and measures the propagation time of the sound at each frequency. The test sound is reproduced from the speaker units 23 in the order of the speaker unit 23R alone, the speaker unit 23L alone, and then both the speaker units 23R and 23L. Thus, in a case in which the number of speaker units 23 is 2, the test sound is sequentially reproduced from one or the other of the two speaker units 23 and then simultaneously reproduced from both of the two speaker units 23. This reproduction makes it possible to acquire information on radiation characteristics observed inside the car 5 when the test sound is radiated separately from each speaker unit 23 and information on radiation characteristics observed inside the car 5 when the test sound is radiated simultaneously from all speaker units 23.

As a result of reproducing the test sound in this way, for example, the two waveforms 60 and 61 of FIG. 20 are obtained. Further, based on the two waveforms 60 and 61, the time difference Δt is calculated as a delay time of the waveform 61 with respect to the waveform 60. The delay control unit 33 calculates the time difference Δt for each frequency and stores it in the storage device.

Further, as shown in FIG. 21, the delay control unit 33 emits the sound of the waveform 61 through each of the speaker units 23 based on the time difference Δt. Then, the delay control unit 33 emits the sound of the waveform 60 through the speaker unit 23 with a delay by the time difference Δt. This causes the waveforms 60 and 61 to reach their respective peak values at the same point in time as shown in FIG. 21.

For ease of explanation, FIGS. 20 and 21 give a description by taking two frequencies of 1 kHz and 500 Hz as an example. However, actual processing involves controlling the timing of radiation of sound for each frequency band of a regular interval. A regular frequency band is for example a ⅓ octave. However, a regular frequency band is not limited to this but may be arbitrarily set.

Further, the delay control unit 33 may be configured, for example, in a manner similar to that in which the directivity control unit 32 is configured as shown in FIG. 19. That is, the delay control unit 33 is formed of adding a delay circuit 52 to a linear phase circuit as shown in FIG. 19. The delay circuit 52 delays a signal by the time difference Δt determined by the delay control unit 33 and outputs the signal.

Thus, the delay control unit 33 measures in advance the propagation time of sound in each frequency band. The delay control unit 33 controls, based on the propagation time for each frequency band, the point in time when the sound is emitted from the speaker unit 23. This allows sounds lying within an entire frequency band to reach a user, making it possible to eliminate deterioration in sound quality due to a delay in propagation time in each frequency band.

[Reverberation Time Control Unit 34]

The reverberation time control unit 34 is described. The reverberation time control unit 34 determines, in advance based, for example, on a spatial capacity of the car 5 and a material of surfaces of the side boards 5*a*, a length of time by which the reverberation time is shortened. The reverberation time control unit 34 eliminates, from the waveform of a sound wave, the waveform of a portion corresponding to the length of time. In this way, the reverberation time control unit 34 controls the reverberation time of an echo produced by the reflection off the side boards 5*a* of the car 5 of a sound wave radiated from each of the speaker units 23.

The car 5 has a cubic or cuboidal shape. Further, the side boards 5*a* of the car 5 are metal walls or metal walls covered with fabric such as nonwoven fabric for decoration. The surfaces of the side boards 5*a* of the car 5 are flat surfaces provided with no particular depressions or projections. In the following, the term "metal wall surfaces" refers to a case in which the side boards 5*a* are formed of bare metal walls, and the term "nonwoven-fabric-covered wall surfaces" refers to a case in which the side boards 5*a* are formed of metal walls covered with nonwoven fabric for decoration.

Therefore, the sound radiated from the speaker unit 23 is reflected off side boards 5*a* facing each other. Further, in a case in which the side boards 5*a* are "metal wall surfaces", the sound is repeatedly reflected off the opposed side boards 5*a*, so that the reflection time of the sound increases in length. Therefore, the reverberation time of the sound is long. Meanwhile, in a case in which the side boards 5*a* are "nonwoven-fabric-covered wall surfaces", the reverberation time of the sound is short, as the nonwoven fabric has a sound-absorbing effect. Furthermore, in a case in which the side boards 5*a* are "nonwoven-fabric-covered wall surfaces", this sound-absorbing effect undesirably excessively reduces the sound pressure level of sounds lying within a certain frequency band. Specifically, as indicated by a waveform 68 in FIG. 27, the sound pressure level is excessively reduced in a frequency band of frequencies higher than or equal to 1 kHz. An example of measures against this problem is an attenuated sound compensation process that will be described later.

Further, the spatial capacity of the car 5 varies from one elevator to another.

Therefore, the reverberation time control unit 34 measures the reverberation time of sound of the car 5 in advance, analyzes frequency characteristics from a time component of the reverberation time, and thereby grasps the situation inside the car 5. Further, the reverberation time control unit 34 applies the reverberation time to a feeling of sound spreading by utilizing the reverberation time as a propagation time of the sound.

For example, the environment inside the car 5 can be broadly classified as any of three specifications. It is common to configure the settings within 2.5 m to 3 m in the direction parallel with the height. It is also possible to simply choose the settings for the feeling of sound spreading during sound field control after the installation of an audio system in an actual car 5. It is also possible to classify the space inside the car 5 as any of three elements such as "large", "medium", and "small" and choose a sound field control method that involves the utilization of a reverberation time corresponding to the size.

Figure 22:
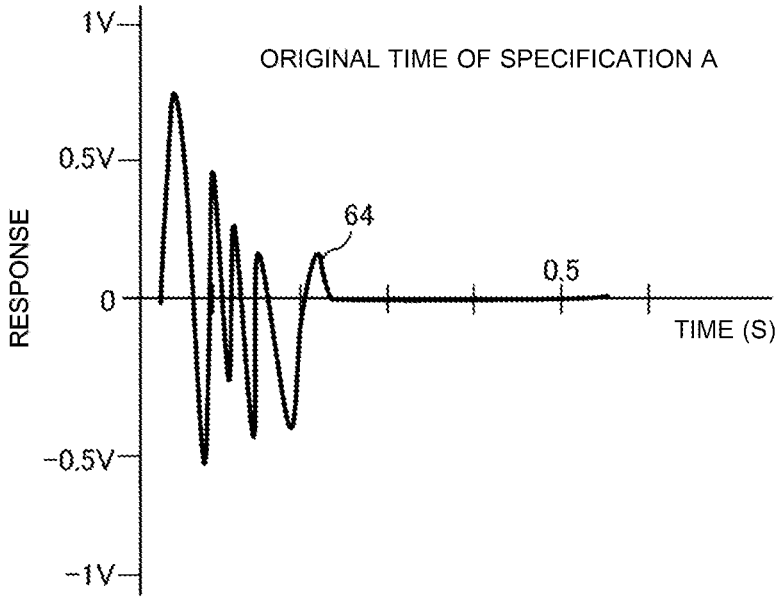
FIG. 22 is a diagram showing the waveform of a sound as measured by the microphones 40 in the case of specification A according to Embodiment 1.
Figure 23:
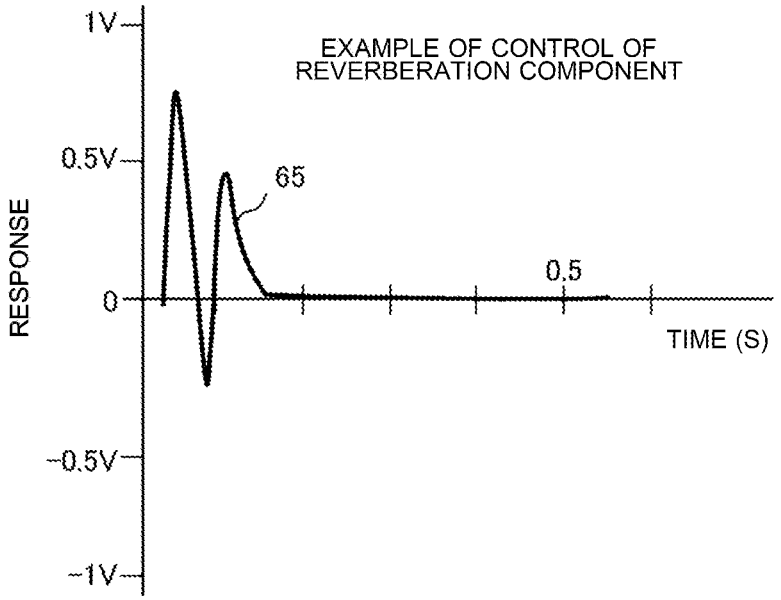
FIG. 23 is a diagram showing the waveform of a sound outputted from a reverberation time control unit 34 according to Embodiment 1.

According to Embodiment 1, for example, the car 5 is classified as any of the following three specifications:

Specification A: Capacity larger than or equal to 5 $m^3$, metal wall surfaces→The reverberation time in this case is shorter than or equal to 0.5 second Specification B: Capacity larger than or equal to 5 $m^3$, nonwoven-fabric-covered wall surfaces→The reverberation time in this case is shorter than or equal to 0.25 second Specification C: Capacity larger than or equal to 10 $m^3$, metal wall surfaces→The reverberation time in this case is shorter than or equal to 0.8 second FIG. 22 is a diagram showing the waveform of a sound as measured by the microphones 40 in the case of specification A according to Embodiment 1. FIG. 23 is a diagram showing the waveform of a sound outputted from the reverberation time control unit 34 according to Embodiment 1. The reverberation time control unit 34 gives the waveform of FIG. 23 by eliminating, from the waveform of FIG. 22, a reverberation time of a length of time corresponding to specification A.

Figure 24:
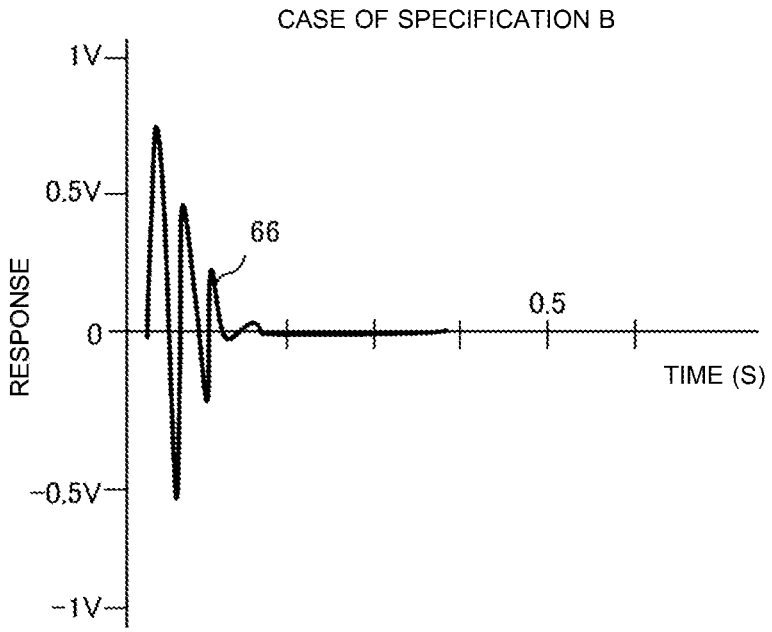
FIG. 24 is a diagram showing the waveform of a sound as measured by the microphones 40 in the case of specification B according to Embodiment 1.
Figure 25:
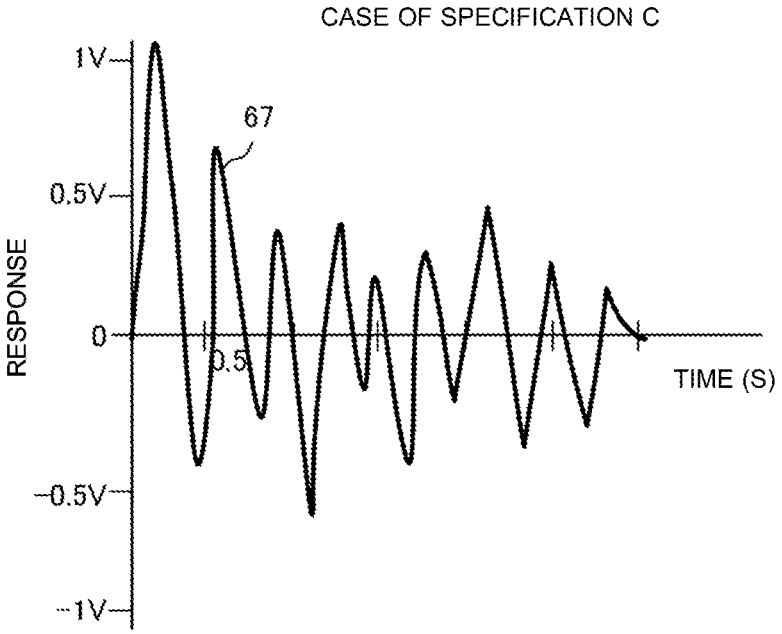
FIG. 25 is a diagram showing the waveform of a sound as measured by the microphones 40 in the case of specification C according to Embodiment 1.

Further, FIG. 24 is a diagram showing the waveform of a sound as measured by the microphones 40 in the case of specification B according to Embodiment 1. FIG. 25 is a diagram showing the waveform of a sound as measured by the microphones 40 in the case of specification C according to Embodiment 1. The reverberation time control unit 34 also conducts, on the waveforms of FIGS. 24 and 25, processes similar to that conducted on the waveform of FIG. 23. That is, the reverberation time control unit 34 gives the waveform of FIG. 23 by eliminating, from the waveforms of FIGS. 24 and 25, reverberation times of lengths of time corresponding to specifications B and C, respectively.

The reverberation time control unit 34 conducts the following process to obtain the waveform of FIG. 23 from each of the waveforms of FIGS. 22, 24, and 25.

By sending out test sound through the speaker units 23 and receiving the test sound through the microphones 40 inside cars 5 of specifications A, B, and C, the reverberation time control unit 34 measures the reverberation time of the sound for each of specifications A, B, and C of the cars 5 and stores the reverberation time in advance in the storage device 39. As the test sound, white noise is used. Further, the reverberation time control unit 34 does not need to conduct tests on all of specifications A, B, and C and may conduct a test only in a car 5 actually provided with speaker units 23.

In each of specifications A, B, and C, the speaker units 23 are installed in position as shown in FIG. 4. Further, a reproduction frequency including the reverberation time is measured within a range of 1.6 to 1.8 m above the floor board 5*b* of the car 5.

Figure 26:
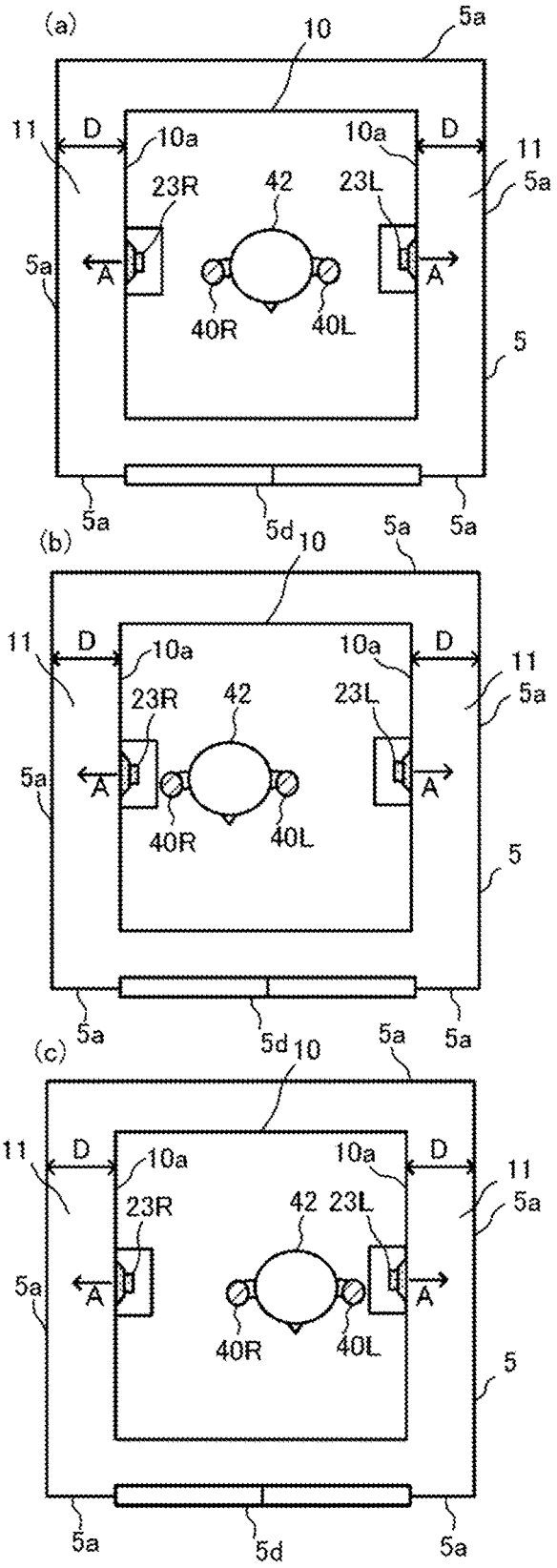
FIG. 26 is a diagram showing a state in which test sound is sent out by the reverberation time control unit 34 provided in the audio system 13 according to Embodiment 1.

FIG. 26 is a diagram showing a state in which test sound is sent out by the reverberation time control unit 34 provided in the audio system 13 according to Embodiment 1. As shown in (a) to (c) of FIG. 26, the passenger model 42 is fitted with the microphones 40R and 40L. After the passenger model 42, fitted with the microphones 40R and 40L, has been installed in a central portion of the car 5 as shown in (a) of FIG. 26, a first round of testing is conducted. Next, after the passenger model 42 has been moved to a right-of-center portion of the car 5 as shown in (b) of FIG. 26, a second round of testing is conducted. Finally, after the passenger model 42 has been moved to a left-of-center portion of the car 5 as shown in (c) of FIG. 26, a third round of testing is conducted. In this way, test sound radiated from the speaker units 23R and 23L is measured with the microphone 40R and 40L in the three states shown in (a) to (c) of FIG. 26. Further, without being bound by these three states, the test sound may be measured with the passenger model 42 installed in a different position other than those of (a) to (c) of FIG. 26. Further, as shown in FIG. 3, if necessary, the passenger model 42 may be further fitted with the microphones 41R and 41L.

By thus conducting more than one round of testing, a difference in audio characteristic from one position to another inside the car 5 can be grasped.

However, since the car 5 is a cubic enclosed space, a passenger is exposed to propagation characteristics including reflections off the side boards 5*a*, no matter where in the car 5 the passenger is. Therefore, in a case in which the side boards 5*a* are metal wall surfaces, the audio characteristics of the car 5 can fortunately give good results even when sound field control characteristics are elaborated solely by results of analysis of audio characteristics in the central portion of the car 5. Accordingly, in a case in which the side boards 5*a* are metal wall surfaces, testing may be conducted only in the state of (a) of FIG. 26.

However, in a case in which the side boards 5*a* are nonwoven-fabric-covered wall surfaces, sound is reflected less, and moreover, the sound absorbing effect of nonwoven fabric causes the audio characteristics inside the car 5 to tend to become attenuated in a high-frequency band. Therefore, in a case in which the side boards 5*a* are nonwoven-fabric-covered wall surfaces, it is necessary to control the characteristics of radiation from the speaker units 23 by conducting testing in at least the three states of (a) to (c) of FIG. 26 and thereby grasping a difference in audio characteristic.

In each of the states of (a) to (c) of FIG. 26, a binaural measurement is conducted by fitting each single channel with a microphone 40 configured to measure two or more sound propagation directions. A human has two ears, and sound from the speaker units 23 arrives at both ears as direct sounds, indirect sounds, and cross sounds. It should be noted that the indirect sounds are reflected sounds. These sound components are measured by the binaural measurement. As a result, these sound components are measured in the form of differences in propagation time.

For example, the differences in propagation time are shown according to measurement position/wall surface condition in the case of radiation of a single-frequency sound of 1 kHz. The direct sounds arrive at the right and left microphones 40 in a short amount of time, and the indirect sounds arrive later than the direct sounds. At this point in time, there is of course a time difference in arrival between the right and left microphones 40R and 40L.

Basically, the following propagation characteristics are measured.

(a) The indirect sounds arrive later than the direct sounds.

(b) There is a difference in propagation time between the cross sound RL and the cross sound LR.

As mentioned above, the control of the propagation characteristic control unit 31 causes the direct sounds to be radiated later than the cross sounds. Note here that the direct sounds that are radiated after the cross sounds are adjusted by the reverberation time of the inside of the car 5. As mentioned above, the reverberation time of sound varies according to specification of the car 5 and is broadly classified as any of the foregoing specifications A to C.

As shown in FIG. 22, in the case of specification A, the reverberation time is shorter than or equal to 0.5 second.

As shown in FIG. 24, in the case of specification B, the reverberation time is shorter than or equal to 0.25 second. Thus, in the case of specification B, the reverberation time is shorter than in the case of specification A. Further, the case of specification B shows, as its frequency characteristics, a trend toward an attenuated sound pressure level of a frequency component higher than 1 kHz as in the case of the waveform 68 of FIG. 27. Therefore, according to Embodiment 1, in the case of specification B, the time difference between a cross sound and a direct sound is adjusted by control of the propagation characteristic control unit 31 to fall within 0.05 s. Making a time difference longer than this time causes a cross sound to be reflected off a wall surface again. This results in the development of an antiphase relationship of sound by wall surface reflection, creating a sense of incongruity attributed to an antiphase component of sound. Therefore, the time difference between a cross sound and a direct sound is adjusted to fall within 0.05 s.

Figure 27:
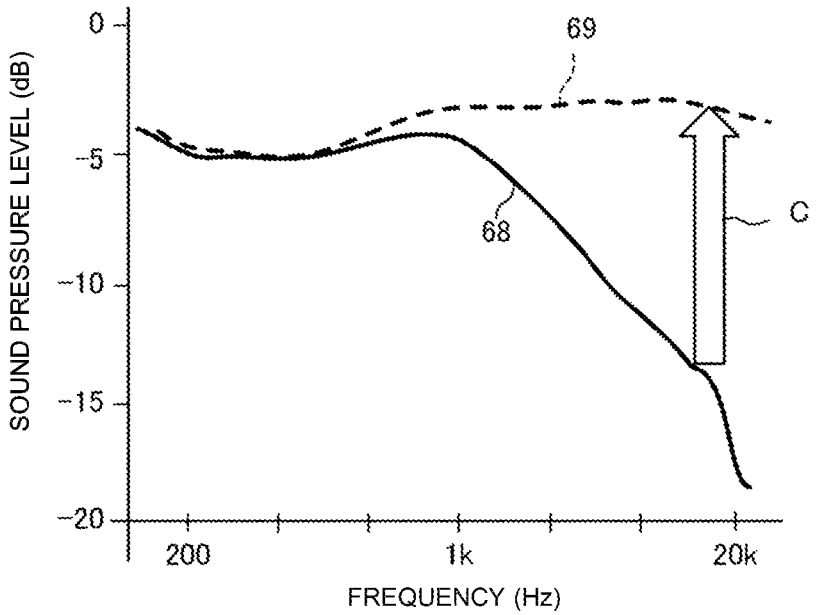
FIG. 27 is a diagram showing an attenuated sound compensation process by the reverberation time control unit 34 according to Embodiment 1.

In the case of specification B, as mentioned above, a high-frequency component higher than 1 kHz is attenuated. Therefore, as shown in FIG. 27, the reverberation time control unit 34 conducts, through an equalizer process, a process of increasing the sound pressure levels of attenuated frequency characteristics so that a feeling of sound quality can be auditorily created. FIG. 27 is a diagram showing an attenuated sound compensation process by the reverberation time control unit 34 according to Embodiment 1. In FIG. 27, the horizontal axis represents frequency, and the vertical axis represents sound pressure level. Further, in FIG. 27, the arrow C indicates the increment of sound pressure level attributed to the equalizer process. This makes it possible to reproduce an attenuated sound component of the waveform 68 to give a waveform 69.

As noted above, the audio system 13 according to Embodiment 1 conducts time-lapse radiation of cross sounds and direct sounds, angle-by-angle and frequency-by-frequency phase control, and reverberation time control. This makes it possible to control the feeling of sound spreading inside the car 5 and give a passenger the illusion that the small space inside the car 5 is a larger indoor space. Thus, the audio system 13 according to Embodiment 1 makes it possible to, while having a reduced number of speaker units, form a stereoscopic sound field environment throughout the inside of the car 5 and thereby bring about improvement in sound quality. This results in making it possible to create a reverberant sound environment, such as a church or a stadium, that is often used as a large indoor space.

Further, according to Embodiment 1, two speaker units 23 are located on either side as a basic configuration. This causes sound to be radiated from either side of a passenger, thus allowing the passenger to feel a more natural sound field.

According to Embodiment 1, the audio system 13 creates a stereoscopic sound field environment. This allows a passenger to enjoy a realistic feeling of being in a large space while being in the small space inside the car 5. Embodiment 1 allows the passenger to auditorily feel space spreading at the same time as the passenger gets on the car 5. This makes it possible to reduce the stress of riding with a stranger in a small space inside the car 5.

Further, as shown in FIG. 7, a plurality of speaker units 23 may be mounted in one speaker cabinet 20. In that case, a frequency band of sounds that are radiated by one speaker unit 23 can be made different from a frequency band of sounds that are radiated by another speaker unit 23, so that various frequency bands can be finely radiated. This results in making it possible to cover a wide frequency band with one speaker cabinet 20. This makes it possible to easily further improve the sound quality of the audio system 13.

Embodiment 2

Figure 28:
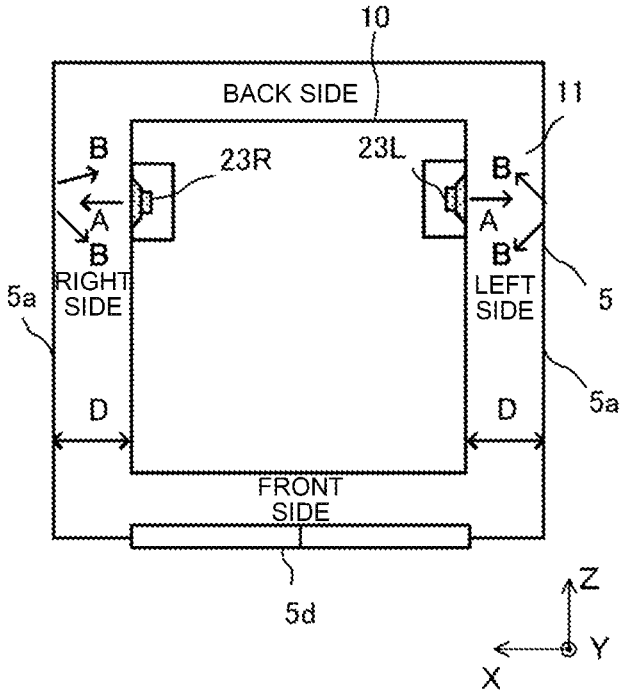
FIG. 28 is a top view showing a configuration of an audio system 13 according to Embodiment 2.

FIG. 28 is a top view showing a configuration of an audio system 13 according to Embodiment 2. For a front view of the audio system 13, refer to FIG. 3, as the front view is basically the same as that of FIG. 3.

A comparison between FIG. 4 and FIG. 28 shows that in FIG. 28, the speaker units 23R and 23L are located closer to the back than the central portion in the Z direction (i.e. the direction parallel with the depth of the car 5). A side of the inside of the car 5 in which the car door 5*d* is provided is herein referred to as "front side", and a side of the inside of the car 5 facing the front side is herein referred to as "back side".

Other components are not described here, as they are similar to those of Embodiment 1.

According to Embodiment 2 too, as shown in FIG. 28, the radiation surfaces 23*a* of the speaker units 23 are disposed to face the right and left side boards 5*a* of the car 5, as in the case of Embodiment 1. That is, each of the radiation surfaces 23*a* is disposed to face the gap 11. Further, the radiation surface 23*a* is located along a side of a side surface 10*a* of the suspended ceiling 10. Accordingly, the position of the radiation surface 23*a* in the X direction (i.e. the direction parallel with the width of the car 5) agrees or substantially agrees with the position of the side surface 10*a* of the suspended ceiling 10 in the X direction. Thus, the radiation surface 23*a* is located in the same plane as the side surface 10*a* of the suspended ceiling 10.

As described above in Embodiment 1, there is a gap 11 of the first distance D between a side board of the suspended ceiling 10 and a side board 5*a* of the car 5. As shown in FIG. 28, the sound radiated from the radiation surface 23*a* of the speaker unit 23 is radiated in the direction of an arrow A from the radiation surface 23*a*. After that, the sound is reflected off the side board 5*a* of the car 5 to turn into reflected sound. As shown in FIG. 28, the reflected sound travels in the directions of arrows B. Thus, according to Embodiment 2 too, "indirect sound radiation" is conducted by which sound is radiated from the suspended ceiling 10 to a passenger through the use of reflection off the side board 5*a* of the car 5, as in the case of Embodiment 1.

As noted above, the audio system 13 according to Embodiment 2 brings about effects similar to those brought about by that of Embodiment 1, as the audio system 13 according to Embodiment 2 is basically similar in configuration to that of Embodiment 1.

Embodiment 3

Figure 29:
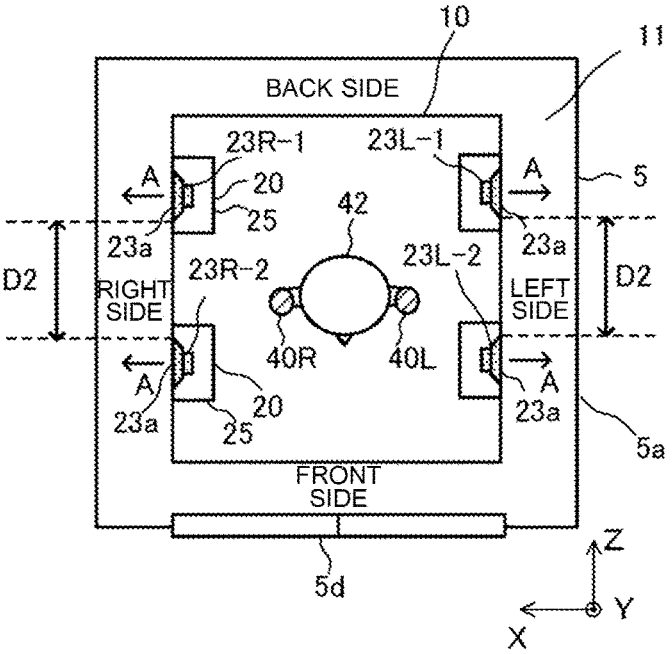
FIG. 29 is a top view showing a configuration of an audio system 13 according to Embodiment 3.

FIG. 29 is a top view showing a configuration of an audio system 13 according to Embodiment 3. For a front view of the audio system 13, refer to FIG. 3, as the front view is basically the same as that of FIG. 3.

A comparison between FIG. 4 and FIG. 29 shows that in FIG. 29, four speaker units 23R-1, 23R-2, 23L-1, and 23L-2 are provided. The speaker units 23R-1 and 23L-1 are located closer to the back than the central portion in the Z direction. Meanwhile, the speaker units 23R-2 and 23L-2 are located closer to the front than the central portion in the Z direction.

The speaker units 23R-1 and the speaker unit 23R-2 are placed at a constant second distance D2 from each other, centering around the central portion of the suspended ceiling 10 in the Z direction. Similarly, the speaker units 23L-1 and the speaker unit 23L-2 are placed at the constant second distance D2 from each other, centering around the central portion of the suspended ceiling 10 in the Z direction. Although it is assumed here that the second distance D2 is the distance between speaker units 23, this case is not intended to impose any limitation. The second distance D2 may be the distance between the casings 25 of speaker cabinets 20.

Other components are not described here, as they are similar to those of Embodiment 1.

According to Embodiment 3 too, as shown in FIG. 29, the radiation surfaces 23*a* of the speaker units 23 are disposed to face the right and left side boards 5*a* of the car 5, as in the case of Embodiment 1. Further, each of the radiation surfaces 23*a* is located along a side of a side surface 10*a* of the suspended ceiling 10. Accordingly, the position of the radiation surface 23*a* in the X direction (i.e. the direction parallel with the width of the car 5) agrees or substantially agrees with the position of the side surface 10*a* of the suspended ceiling 10 in the X direction.

As described above in Embodiment 1, there is a gap 11 of the first distance D between a side board of the suspended ceiling 10 and a side board 5*a* of the car 5. As shown in FIG. 29, the sound radiated from the four speaker units 23 is radiated in the directions of arrows A from the radiation surfaces 23*a*. After that, the sound is reflected off the side boards 5*a* of the car 5 to turn into reflected sound that is radiated to the inside of the car 5. Thus, according to Embodiment 3 too, "indirect sound radiation" is conducted by which sound is radiated from the suspended ceiling 10 to a passenger through the use of reflection off the side boards 5*a* of the car 5, as in the case of Embodiment 1.

As noted above, the audio system 13 according to Embodiment 3 brings about effects similar to those brought about by that of Embodiment 1, as the audio system 13 according to Embodiment 3 is basically similar in configuration to that of Embodiment 1. Further, according to Embodiment 3, the number of speaker units 23 is larger than in Embodiment 1. This makes it possible to form a more stereoscopic sound field environment with higher sound quality, thus making it possible to more noticeably experience a pseudo-large space.

Embodiment 4

Figure 30:
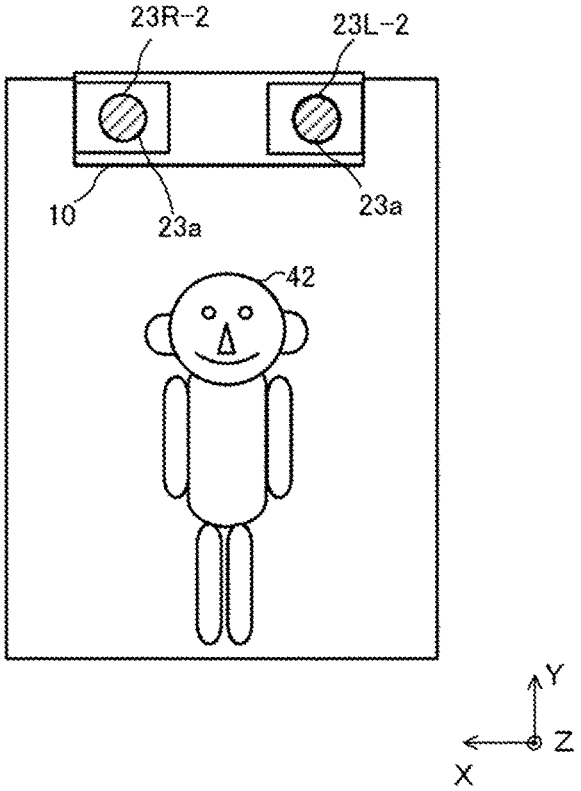
FIG. 30 is a front view showing a configuration of an audio system 13 according to Embodiment 4.
Figure 31:
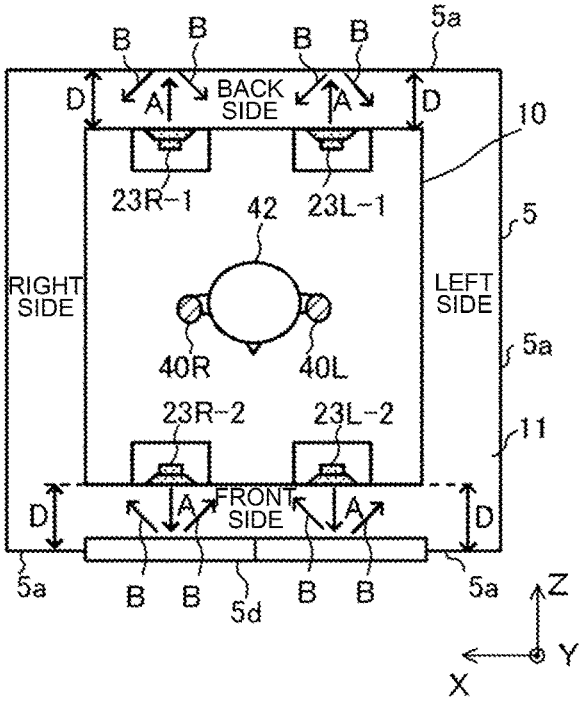
FIG. 31 is a top view showing the configuration of the audio system 13 according to Embodiment 4.

FIG. 30 is a front view showing a configuration of an audio system 13 according to Embodiment 4. FIG. 31 is a top view showing the configuration of the audio system 13 according to Embodiment 4.

A comparison between FIG. 4 and FIG. 31 shows that in FIG. 31, four speaker units 23R-1, 23R-2, 23L-1, and 23L-2 are provided. Further, in FIG. 4 described above, the speaker units 23 are placed opposite the right and left side boards 5*a* of the car 5. However, in FIG. 31, the four speaker units 23R-1, 23R-2, 23L-1, and 23L-2 are placed opposite the front and back side boards 5*a* of the car 5.

Further details are described. Two speaker units 23R-1 and 23L-1 are placed opposite the back side board 5*a* of the car 5. The speaker units 23R-1 and the speaker unit 23L-1 are placed at a constant distance from each other, centering around the central portion of the suspended ceiling 10 in the X direction. The constant distance may for example be equal to the second distance D2 shown in FIG. 29.

Further, the other speaker units 23R-2 and 23L-2 are placed opposite the front side board 5*a* of the car 5. Accordingly, as shown in FIG. 30, the radiation surfaces 23*a* of the speaker units 23R-2 and 23L-2 are disposed in a direction toward the car door 5*d*. The speaker units 23R-2 and the speaker unit 23L-2 are placed at a constant distance from each other, centering around the central portion of the suspended ceiling 10 in the X direction. The constant distance may for example be equal to the second distance D2 shown in FIG. 29.

Other components are not described here, as they are similar to those of Embodiment 1.

According to Embodiment 3 too, as shown in FIG. 31, each of the radiation surfaces 23*a* of the speaker units 23 is disposed to face a corresponding one of the side boards 5*a* of the car 5, as in the case of Embodiment 1. Further, each of the radiation surfaces 23*a* is located along a side of a side surface 10*a* of the suspended ceiling 10. Accordingly, the position of the radiation surface 23*a* in the Z direction (i.e. the direction parallel with the depth of the car 5) agrees or substantially agrees with the position of the side surface 10*a* of the suspended ceiling 10 in the Z direction.

As described above in Embodiment 1, there is a gap 11 of the first distance D between a side board of the suspended ceiling 10 and a side board 5*a* of the car 5. As shown in FIG. 31, the sound radiated from the four speaker units 23 is radiated in the directions of arrows A from the radiation surfaces 23*a*. After that, the sound is reflected off the side boards 5*a* of the car 5 to turn into reflected sound. As shown in FIG. 31, the reflected sound travels in the directions of arrows B. Thus, according to Embodiment 4 too, "indirect sound radiation" is conducted by which sound is radiated from the suspended ceiling 10 to a passenger through the use of reflection off the side boards 5*a* of the car 5, as in the case of Embodiment 1.

As noted above, the audio system 13 according to Embodiment 4 brings about effects similar to those brought about by that of Embodiment 1, as the audio system 13 according to Embodiment 4 is basically similar in configuration to that of Embodiment 1. Further, according to Embodiment 4, the number of speaker units 23 is larger than in Embodiment 1. This makes it possible to form a more stereoscopic sound field environment with higher sound quality, thus making it possible to more noticeably experience a pseudo-large space.

Embodiment 5

Figure 32:
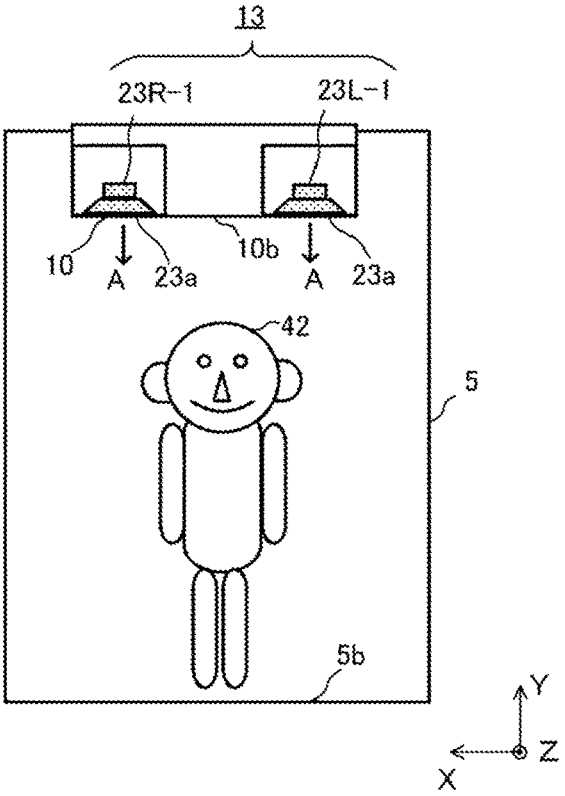
FIG. 32 is a front view schematically showing a configuration of an audio system 13 according to Embodiment 5.
Figure 33:
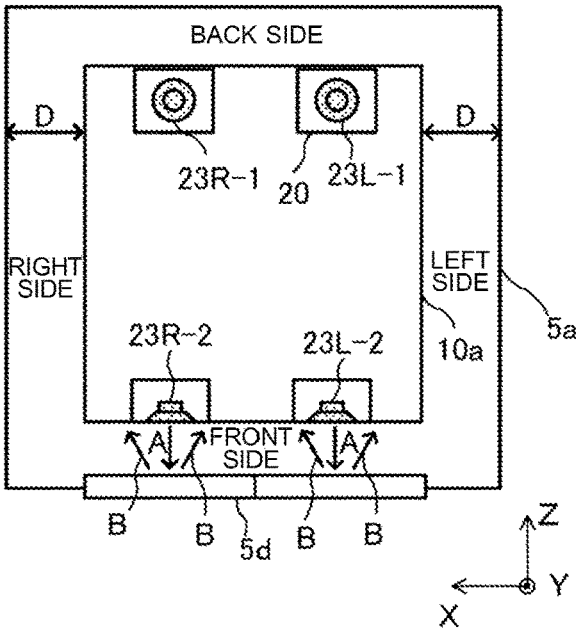
FIG. 33 is a top view showing the configuration of the audio system 13 according to Embodiment 5.

FIG. 32 is a front view schematically showing a configuration of an audio system 13 according to Embodiment 5. FIG. 33 is a top view showing the configuration of the audio system 13 according to Embodiment 5.

According to Embodiment 5, as shown in FIG. 33, four speaker units 23R-1, 23R-2, 23L-1, and 23L-2 are provided. In FIG. 33, two of the four speaker units 23R-1, 23R-2, 23L-1, and 23L-2, namely the speaker units 23R-2 and 23L-2, are placed opposite the front side board 5*a* of the car 5. Further, the other two speaker units 23R-1 and 23L-1 are provided opposite the floor board 5*b* of the car 5. Accordingly, the radiation surfaces 23*a* of the speaker units 23R-1 and 23L-1 are disposed to face the floor board 5*b* of the car 5 as shown in FIG. 32.

Further details are described. As shown in FIG. 33, the two front speaker units 23R-2 and 23L-2 are placed opposite the front side board 5*a* of the car 5. The speaker units 23R-2 and the speaker unit 23L-2 are placed at a constant distance from each other, centering around the central portion of the suspended ceiling 10 in the X direction. The constant distance may for example be equal to the second distance D2 shown in FIG. 29.

Accordingly, each of the radiation surfaces 23*a* of the speaker units 23R-2 and 23L-2 is disposed to face a corresponding one of the side boards 5*a* of the car 5. Further, each of the radiation surfaces 23*a* is located along a side of a side surface 10*a* of the suspended ceiling 10. Accordingly, the position of each of the radiation surfaces 23*a* in the Z direction (i.e. the direction parallel with the depth of the car 5) agrees or substantially agrees with the position of a corresponding one of the side surfaces 10*a* of the suspended ceiling 10 in the Z direction.

As described above in Embodiment 1, there is a gap 11 of the first distance D between a side board of the suspended ceiling 10 and a side board 5*a* of the car 5. As shown in FIG. 33, the sound radiated from the speaker units 23R-2 and 23L-2 is radiated in the directions of arrows A from the radiation surfaces 23*a*. After that, the sound is reflected off the side boards 5*a* of the car 5 to turn into reflected sound. As shown in FIG. 33, the reflected sound travels in the directions of arrows B. Thus, the speaker units 23R-2 and 23L-2 conduct "indirect sound radiation" by which the speaker units 23R-2 and 23L-2 radiate sound from the suspended ceiling 10 to a passenger through the use of reflection off the side boards 5*a* of the car 5.

Meanwhile, the two back speaker units 23R-1 and 23L-1 are placed opposite the floor board 5*b* of the car 5. Accordingly, as mentioned above, the radiation surfaces 23*a* of the speaker units 23R-1 and 23L-1 are disposed to face the floor board 5*b* of the car 5 as shown in FIG. 32. The speaker units 23R-1 and the speaker unit 23L-1 are placed at a constant distance from each other, centering around the central portion of the suspended ceiling 10 in the X direction. The constant distance may for example be equal to the second distance D2 shown in FIG. 29.

As shown in FIG. 32, each of the radiation surfaces 23*a* of the speaker units 23R-1 and 23L-1 is located in the same plane as the lower surface 10*b* of the suspended ceiling 10. Accordingly, the position of each of the radiation surfaces 23*a* in the Y direction (i.e. the direction parallel with the height of the car 5) agrees or substantially agrees with the position of the lower surface 10*b* of the suspended ceiling 10 in the Y direction. Further, the radiation surfaces 23*a* of the speaker units 23R-1 and 23L-1 are fitted in mounting holes provided in the lower surface 10*b* of the suspended ceiling 10. Each of the radiation surfaces 23*a* of the speaker units 23R-1 and 23L-1 is exposed to the outside through a corresponding one of the mounting holes. Accordingly, sound radiated from each of the radiation surfaces 23*a* of the speaker units 23R-1 and 23L-1 is not insulated by the lower surface 10*b* of the suspended ceiling 10.

As shown in FIG. 32, the sound radiated from the speaker units 23R-1 and 23L-1 is radiated in the directions of arrows A from the radiation surfaces 23*a*. Thus, the speaker units 23R-1 and 23L-1 conduct "direct sound radiation" by which the speaker units 23R-1 and 23L-1 radiate sound from the suspended ceiling 10 directly to a passenger.

Thus, according to Embodiment 5, a combination of "indirect sound radiation" and "direct sound radiation" is conducted.

Other components are not described here, as they are similar to those of any of Embodiments 1 to 4.

As noted above, the audio system 13 according to Embodiment 5 brings about effects similar to those brought about by that of Embodiment 1, as the audio system 13 according to Embodiment 5 is basically similar in configuration to that of Embodiment 1. Further, according to Embodiment 5, the number of speaker units 23 is larger than in Embodiment 1. This makes it possible to form a more stereoscopic sound field environment with higher sound quality, thus making it possible to more noticeably experience a pseudo-large space. According to Embodiment 5, both "indirect sound radiation" and "direct sound radiation" are conducted. This makes it possible to form a stereoscopic sound field environment with high sound quality.

Embodiment 6

Figure 34:
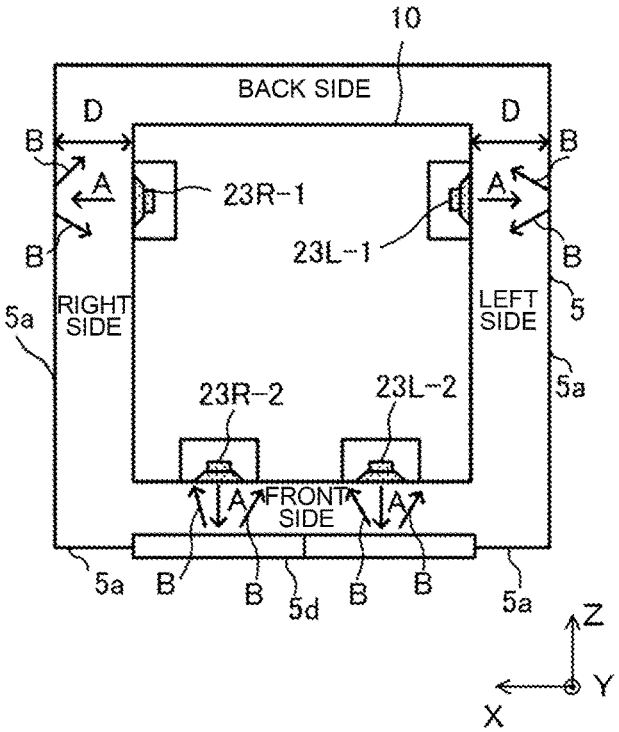
FIG. 34 is a top view showing a configuration of an audio system 13 according to Embodiment 6.

FIG. 34 is a top view showing a configuration of an audio system 13 according to Embodiment 6. For a front view of the audio system 13, refer to FIG. 30, as the front view is basically the same as that of FIG. 30.

As shown in FIG. 34, four speaker units 23R-1, 23R-2, 23L-1, and 23L-2 are provided. In FIG. 34, the two back speaker units 23R-1 and 23L-1 are placed opposite the right and left side boards 5*a* of the car 5. Accordingly, the speaker units 23R-1 and 23L-1 have their back surfaces facing each other. The speaker units 23R-1 and 23L-1 are located closer to the back than the central portion in the Z direction.

Meanwhile, the two front speaker units 23R-2 and 23L-2 are placed opposite the front side board 5*a* of the car 5. The speaker units 23R-2 and 23L-2 are placed at a constant distance from each other, centering around the central portion of the suspended ceiling 10 in the X direction. The constant distance may for example be equal to the second distance D2 shown in FIG. 29.

Other components are not described here, as they are similar to those of any of Embodiments 1 to 5.

According to Embodiment 6 too, as shown in FIG. 34, each of the radiation surfaces 23*a* of the speaker units 23 is disposed to face a corresponding one of the side boards 5*a* of the car 5, as in the case of Embodiment 1. Further, each of the radiation surfaces 23*a* is located along a side of a side surface 10*a* of the suspended ceiling 10. Accordingly, each of the radiation surface 23*a* is located in the same plane as a corresponding one of the side surfaces 10*a* of the suspended ceiling 10.

As described above in Embodiment 1, there is a gap 11 of the first distance D between a side board of the suspended ceiling 10 and a side board 5*a* of the car 5. As shown in FIG. 34, the sound radiated from the four speaker units 23 is radiated in the directions of arrows A from the radiation surfaces 23*a*. After that, the sound is reflected off the side boards 5*a* of the car 5 to turn into reflected sound. As shown in FIG. 34, the reflected sound travels in the directions of arrows B. Thus, according to Embodiment 6 too, "indirect sound radiation" is conducted by which sound is radiated from the suspended ceiling 10 to a passenger through the use of reflection off the side boards 5*a* of the car 5, as in the case of Embodiment 1.

As noted above, the audio system 13 according to Embodiment 6 brings about effects similar to those brought about by that of Embodiment 1, as the audio system 13 according to Embodiment 6 is basically similar in configuration to that of Embodiment 1. Further, according to Embodiment 6, the number of speaker units 23 is larger than in Embodiment 1. This makes it possible to form a more stereoscopic sound field environment with higher sound quality, thus making it possible to more noticeably experience a pseudo-large space.

Embodiment 7

Figure 35:
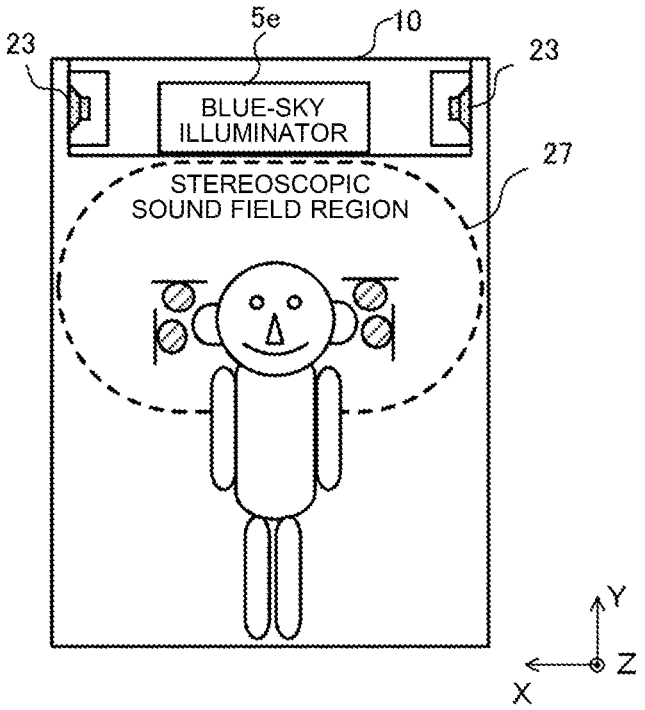
FIG. 35 is a front view showing a configuration of an audio system 13 according to Embodiment 7.

FIG. 35 is a front view showing a configuration of an audio system 13 according to Embodiment 7. As described above with reference to FIG. 2, the lighting device 5*e* is provided inside the suspended ceiling 10. According to Embodiment 7, as shown in FIG. 35, the lighting device 5*e* is formed of a blue-sky illuminator. The blue-sky illuminator reproduces the color of a clear blue sky on a sunny day, for example, through a combination of blue LEDs and white LEDs. Accordingly, installing the blue-sky illuminator makes it possible to provide a passenger with a realistic feeling of having a skylight on the ceiling of the car 5.

Figure 36:
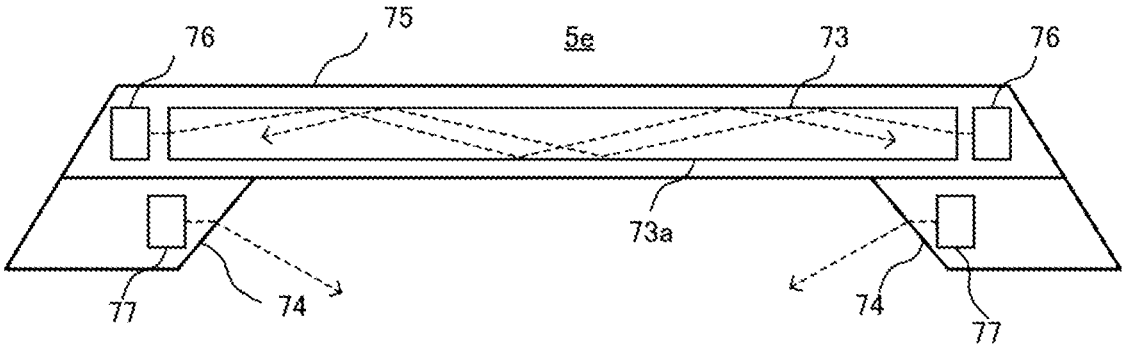
FIG. 36 is a cross-sectional view showing a configuration of a lighting device 5*e* according to Embodiment 7.

FIG. 36 is a cross-sectional view showing a configuration of the lighting device 5*e* according to Embodiment 7. As shown in FIG. 36, blue LEDs 76 and white LEDs 77 are provided inside a housing 75. Further, a light-guiding plate 73 is provided between the two blue LEDs 76, which face each other. The blue LEDs 76 and the light-guiding plate 73 form a blue-sky panel. The light-guiding plate 73 includes a light scatterer inside. Light emitted from the blue LEDs 76 enter the light-guiding plate 73 through ends of the light-guiding plate 73. The light travels through the inside of the light-guiding plate 73 while being totally reflected by upper and lower surfaces of the light-guiding plate 73. In so doing, the light scatters upon striking the light scatterer of the light-guiding plate 73. The light scatterer causes Rayleigh scattering to be simulated. Rayleigh scattering is a phenomenon that, when sunlight enters the atmosphere, occurs due to molecules forming the atmospheric air. The light scattered by the light scatterer turns into blue light that is emitted downward from an emission surface 73*a* of the light-guiding plate 73. This causes blue sky to be reproduced. Meanwhile, light emitted from the white LEDs 77 is emitted from a light-emitting surface 74 provided in a frame. This causes natural light coming through the skylight to be expressed. Thus, in a case in which the lighting device 5*e* is a blue-sky illuminator, blue sky and natural light can be expressed with a sense of depth inside the car 5 by a low-profile blue-sky panel and a frame configured to express sunlight streaming.

Other components are not described here, as they are similar to those of any of Embodiments 1 to 6.

As noted above, the audio system 13 according to Embodiment 7 brings about effects similar to those brought about by that of Embodiment 1, as the audio system 13 according to Embodiment 7 is basically similar in configuration to that of Embodiment 1. Further, according to Embodiment 7, the lighting device 5*e* is formed of a blue-sky illuminator. This allows a passenger inside the car 5 to auditorily and visually experience a pseudo-large space.

The invention claimed is:

1. An audio system for an elevator, comprising:

two or more speaker cabinets arranged inside a suspended ceiling fixed to a ceiling board of a car of the elevator;

an input device to which sound content radiated to an inside of the car from each of the two or more speaker cabinets are input; and a sound field control device configured to conduct phase control and reverberation time control for the sound content and thereby cause a sound wave based on the sound content to be radiated from the speaker cabinet to the inside of the car, wherein each of the speaker cabinets includes a casing arranged inside the suspended ceiling, and a speaker unit arranged inside the casing and having a radiation surface that radiates the sound wave, and wherein the sound field control device includes a propagation characteristic control unit configured to control, based on a difference in propagation time between a direct sound arriving at one of a pair of virtual microphones and a cross sound arriving at an other of the pair of virtual microphones when the sound wave radiated from the radiation surface arrives at the pair of virtual microphones, a propagation characteristic of the sound wave.

2. The audio system of claim 1, wherein the propagation characteristic control unit has stored in advance therein the difference in propagation time between the direct sound and the cross sound and causes the direct sound to be radiated from the radiation surface later than the cross sound by a first delay time equivalent to the difference in propagation time.

3. The audio system of claim 1, wherein the sound field control device includes a directivity control unit configured to conduct a control as the phase control to control, based on a directivity angle of the sound wave radiated from the radiation surface, a directivity of the sound wave.

4. The audio system of claim 3, wherein based on an angle formed by a direction of directivity of the sound wave radiated from the radiation surface and a direction of installation of one virtual microphone, the directivity control unit causes a peak time of a sound pressure of the sound wave to coincide with a reference time.

5. The audio system of claim 1, wherein the sound field control device includes a delay control unit configured to conduct a control as the phase control to control a delay in propagation time derived from a frequency of the sound wave radiated from the radiation surface.

6. The audio system of claim 5, wherein the delay control unit stores a propagation time of the sound wave at each frequency in advance therein and, when sound waves of a plurality of frequencies are radiated from the radiation surface, controls timing of radiation of those sound waves based on the propagation time of the sound wave at each frequency so that peaks of phases of the sound waves of the plurality of frequencies coincide with each other.

7. The audio system of claim 1, wherein the sound field control device includes a reverberation time control unit configured to conduct a control as the reverberation time control to control a reverberation time of an echo produced by reflection off a side board of the car of the sound wave radiated from the radiation surface.

8. The audio system of claim 7, wherein the reverberation time control unit determines, based on a material of the side board of the car and a capacity of the car, a length of time by which the reverberation time of the echo is shortened and eliminates, from a waveform of the sound wave, a waveform of a portion corresponding to the length of time.

9. The audio system of claim 1, wherein the casing is a closed apparatus, and the sound wave is radiated outward from the radiation surface, and is not radiated outward via other parts of the casing other than the radiation surface.

* * * * *